US009115889B2

(12) United States Patent
Fukunishi et al.

(10) Patent No.: US 9,115,889 B2
(45) **Date of Patent: *Aug. 25, 2015**

(54) RICH-LEAN COMBUSTION BURNER AND COMBUSTION APPARATUS

(71) Applicant: NORITZ CORPORATION, Hyogo (JP)

(72) Inventors: Keigo Fukunishi, Hyogo (JP); Takeshi Wakada, Hyogo (JP); Toshio Watanabe, Hyogo (JP); Takashi Akiyama, Hyogo (JP); Yasutaka Kuriyama, Hyogo (JP); Itsuo Nagai, Hyogo (JP); Norihide Wada, Hyogo (JP); Ryosuke Umakoshi, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 347 days.

This patent is subject to a terminal disclaimer.

(21) Appl. No.: 13/708,169

(22) Filed: Dec. 7, 2012

(65) Prior Publication Data

US 2013/0149653 A1 Jun. 13, 2013

(30) Foreign Application Priority Data

Dec. 9, 2011 (JP) ..... 2011-270692
Dec. 9, 2011 (JP) ..... 2011-270693

(51) Int. Cl.

| | |
|---|---|
| ***F23D 14/46*** | (2006.01) |
| ***F23D 14/02*** | (2006.01) |
| ***F23D 14/58*** | (2006.01) |
| ***F23D 14/70*** | (2006.01) |
| ***F23D 14/84*** | (2006.01) |

(52) U.S. Cl.

CPC ..... *F23D 14/02* (2013.01); *F23D 14/586* (2013.01); *F23D 14/70* (2013.01); *F23D 14/84* (2013.01); *F23D 2213/00* (2013.01); *F23D 2900/00003* (2013.01)

(58) Field of Classification Search

None

See application file for complete search history.

(56) References Cited

U.S. PATENT DOCUMENTS

| | | | | | |
|---|---|---|---|---|---|
| 2,470,880 | A | * | 5/1949 | Zimbelman et al. | 239/556 |
| 2,525,960 | A | * | 10/1950 | Shaw | 239/423 |
| 2,541,710 | A | * | 2/1951 | Miller | 239/427.3 |
| 2,572,273 | A | * | 10/1951 | Miller et al. | 239/553.3 |

(Continued)

FOREIGN PATENT DOCUMENTS

| | | | |
|---|---|---|---|
| JP | 07-042913 | A | 2/1995 |
| JP | 07-042917 | A | 2/1995 |

(Continued)

*Primary Examiner* — Gregory Huson
*Assistant Examiner* — Martha Becton
(74) *Attorney, Agent, or Firm* — Fishman Stewart Yamaguchi PLLC

(57) ABSTRACT

In a rich-lean combustion burner, each of outer rich-side flame holes disposed on both outer sides is supplied with rich-side mixture in the same amount and mixing state as the others. A lower end part of a central rich-side burner part is projected into an interior of a tubular part to which a rich-side mixture is introduced. First communication holes are opened, respectively, in both side walls of the lower end part. A second and a third communication holes in fluid communication with an outer rich-side burner part are opened in a tubular part. The second and the third communication holes are oriented so as to face each other without any obstruction, other than a space, therebetween. Furthermore, a pocket part which is a space part adapted to collect and accumulate dust particles is formed on the downstream side up to a closed end.

8 Claims, 15 Drawing Sheets

(56) References Cited

U.S. PATENT DOCUMENTS

| | | | | | |
|---|---|---|---|---|---|
| D165,883 | S | * | 2/1952 | Soloman et al. | D23/415 |
| 2,746,799 | A | * | 5/1956 | Nelson | 239/279 |
| 2,828,532 | A | * | 4/1958 | Taylor | 29/890.02 |
| 2,940,517 | A | * | 6/1960 | Skellern | 239/289 |
| 3,215,186 | A | * | 11/1965 | Levitt | 431/126 |
| 3,512,910 | A | * | 5/1970 | Hein | 431/154 |
| 3,526,367 | A | * | 9/1970 | Trihey | 239/556 |
| 3,615,249 | A | * | 10/1971 | Martois | 422/183 |
| 3,708,126 | A | * | 1/1973 | De Kinkelder | 239/590.5 |
| 4,185,780 | A | * | 1/1980 | Duchene et al. | 239/553.5 |
| 4,222,526 | A | * | 9/1980 | Halstead | 239/556 |
| 4,417,868 | A | * | 11/1983 | Putnam | 431/1 |
| 4,940,406 | A | * | 7/1990 | Kee | 431/22 |
| 5,062,788 | A | * | 11/1991 | Best | 431/7 |
| 5,073,106 | A | * | 12/1991 | Toyonaga et al. | 431/285 |
| 5,099,879 | A | * | 3/1992 | Baird | 137/561 A |
| 5,318,438 | A | * | 6/1994 | Sugahara et al. | 431/285 |
| 5,368,476 | A | * | 11/1994 | Sugahara et al. | 431/285 |
| 5,525,054 | A | * | 6/1996 | Nakaura et al. | 431/285 |
| 5,833,449 | A | * | 11/1998 | Knight et al. | 431/191 |
| 6,000,934 | A | * | 12/1999 | Shavers et al. | 431/354 |
| 6,746,236 | B2 | * | 6/2004 | Kuriyama et al. | 431/354 |
| 6,960,077 | B2 | * | 11/2005 | Buccilli et al. | 431/354 |
| 7,137,568 | B1 | * | 11/2006 | LaCrosse | 239/1 |
| D672,869 | S | * | 12/2012 | Akiyama et al. | D23/415 |
| D681,801 | S | * | 5/2013 | Akiyama et al. | D23/415 |
| 2012/0156629 | A1 | * | 6/2012 | Akiyama et al. | 431/354 |
| 2012/0219920 | A1 | * | 8/2012 | Akiyama et al. | 431/278 |
| 2012/0308945 | A1 | * | 12/2012 | Wada et al. | 431/278 |
| 2013/0149653 | A1 | * | 6/2013 | Fukunishi et al. | 431/278 |
| 2013/0171576 | A1 | * | 7/2013 | Akiyama et al. | 431/354 |
| 2013/0247844 | A1 | * | 9/2013 | Cheng et al. | 122/18.4 |

FOREIGN PATENT DOCUMENTS

| | | | |
|---|---|---|---|
| JP | 07-091620 | A | 4/1995 |
| JP | 07-127819 | A | 5/1995 |
| JP | 11-051328 | A | 2/1999 |
| JP | 2002-048312 | A | 2/2002 |
| JP | 2002-048314 | A | 2/2002 |
| JP | 2002-115817 | A | 4/2002 |
| JP | 2003-269705 | A | 9/2003 |
| JP | 2003-269707 | A | 9/2003 |
| JP | 2007-285536 | A | 11/2007 |

* cited by examiner

Fig. 1
Fig.1(a)
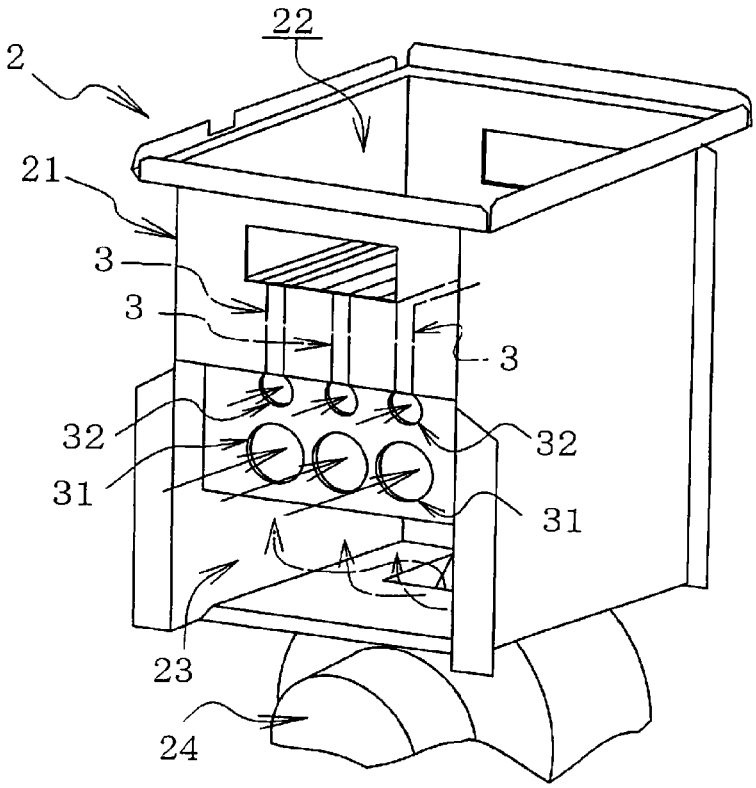
Fig.1(b)
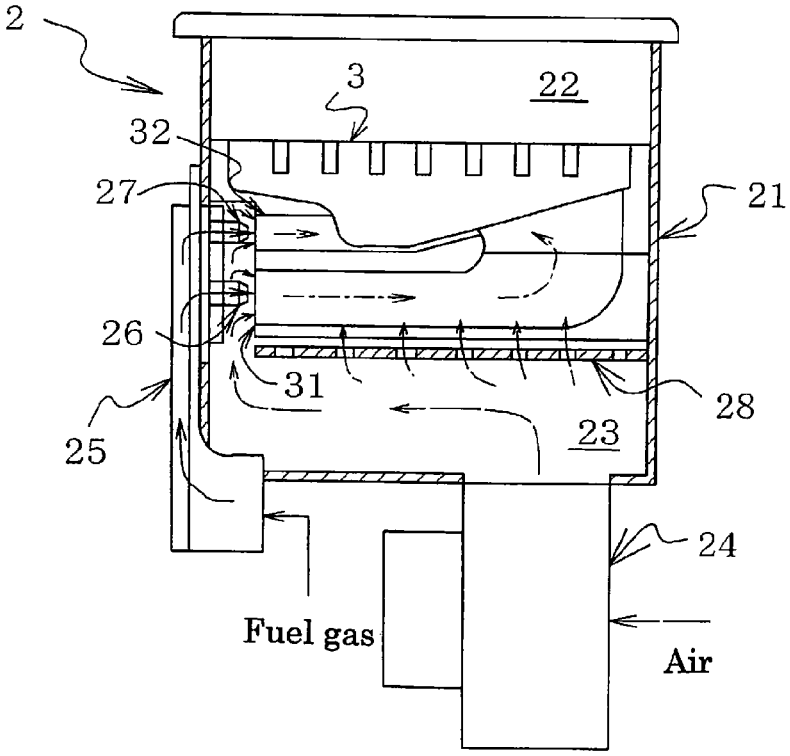

Fig. 3
Fig.3 (a)
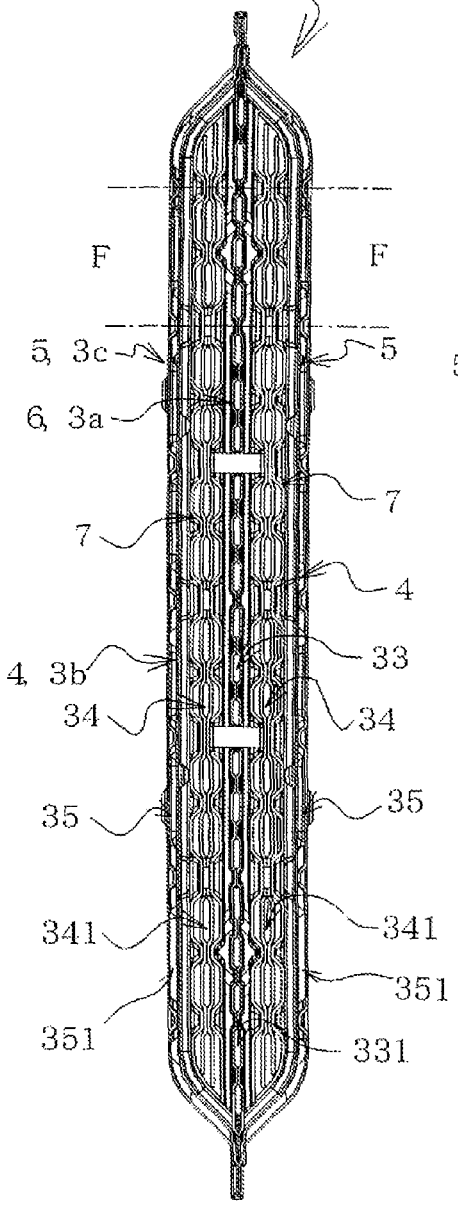
Fig.3 (b)
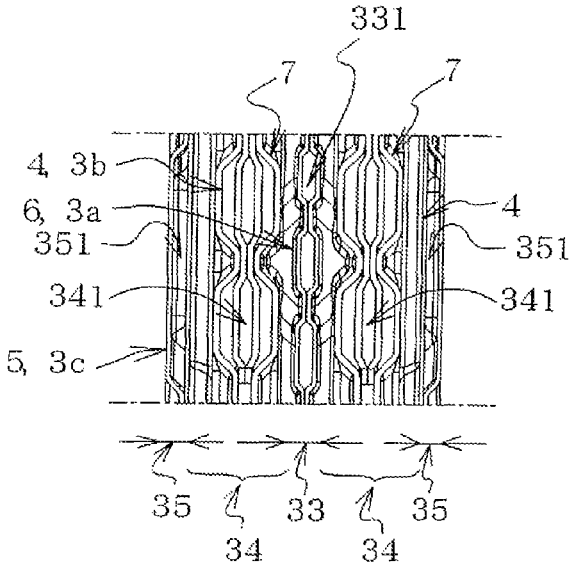

RICH-LEAN COMBUSTION BURNER AND COMBUSTION APPARATUS

TECHNICAL FIELD

This invention relates to a rich-lean combustion burner which is provided with rich-side and lean-side flame holes, and to a combustion apparatus which is equipped with such a rich-lean combustion burner. In particular, the present invention relates to a rich-lean combustion burner comprising rich-side and lean-side flame holes, and specifically to the technology that provides positive assurance that each rich-side flame holes is supplied with rich-side mixture, in a rich-lean combustion burner having such an arrangement of flame holes that two rows of lean-side flame holes are arranged on both sides so as to face each other, with a row of central rich-side flame holes interposed therebetween and, in addition, two rows of rich-side flame holes are arranged, respectively, on the outsides of the two lean-side flame hole rows. More specifically, the present invention is concerned with the technology that enables avoidance of the possibility that an improper supply of rich-side mixture to the central and the outer rich-side flame holes may take place due to adhesion of dust particles in a rich-side mixture supply channel. Alternatively, the present invention is concerned with the technology that enables each of the rich-side flame holes of the two outer rich-side flame hole rows to be supplied with rich-side mixture in the same amount and the same mixing state as the other rich-side flame holes.

BACKGROUND ART

Heretofore, various types of rich-lean combustion burners have been proposed. With a view to accomplishing $NO_x$ reductions, it is arranged that a lean-side mixture whose air ratio (the ratio of the amount of air to the amount of fuel) is in excess of 1.0 is burned at lean-side flame holes while on the other hand, with a view to accomplishing combustion-flame stability, it is arranged that rich-side flame holes, at which a rich-side mixture whose air ratio falls below 1.0 is burned, are arranged adjacent to the lean-side flame holes. For example, there is proposed in Patent Literature Publication 1 a rich-lean combustion burner comprising a row of lean-side flame holes which extends in the front-back direction (i.e., in the longitudinal direction) and a pair of rows of rich-side flame holes which extend in the front-back direction on both horizontal sides (both lateral sides), with the lean-side flame hole row interposed between the two rich-side flame hole rows. And, in such a rich-lean combustion burner, it is proposed that a common inlet port for supplying of rich-side mixture to the rich-side flame hole rows and an inlet port for supplying of lean-side mixture to the lean-side flame hole row are provided separately from each other.

Additionally, there has been a proposal to construct a rich-lean combustion burner whose entire shape is flat by joining or welding together thin plate members formed into their predetermined shapes by stamping process or other like shape forming process. For example, in Patent Literature Publication 2, it is proposed to form a rich-lean combustion burner comprising a row of lean-side flame holes which is sandwiched, from its both sides, between two rows of rich-side flame holes by multiple folding of a single sheet of thin material, whereby to accomplish work improvements in cutting process to be performed on individual members as well as in joining/welding process to be performed on the individual members.

CITATION LIST

Patent Literature

Patent Literature Publication 1: Japanese Patent No. 2690447

Patent Literature Publication 2: JP-A-2002-48312

SUMMARY OF INVENTION

Technical Problem

Incidentally, for the case of a rich-lean combustion burner as proposed in Patent Literature Pub. 1 or Patent Literature Pub. 2 in which two rows of rich-side flame holes are simply arranged in an opposite relation to each other, with a single row of lean-side flame holes interposed between the two rich-side flame hole rows, it is possible to provide the supply of rich-side mixture to the rich-side flame holes on both sides through the common inlet port. However, in the rich-lean combustion burner currently under development by the applicant of the present invention, the following troublesome conditions will take place. In other words, the applicant of the present invention is now trying to develop a rich-lean combustion burner. This rich-lean combustion burner has a configuration comprising not only an arrangement sequence of RICH-LEAN-RICH (i.e., an arrangement sequence made of three flame hole rows) in which two rows of rich-side flame holes are arranged on either side of a single row of lean-side flame holes, but also another row of rich-side flame holes extending on the centerline of the lean-side flame hole row. That is, rich-side flame holes and lean-side flame holes are alternately arranged, for example, in an arrangement sequence: RICH-LEAN-RICH-LEAN-RICH in the lateral direction (i.e., in the lateral width direction). However, in order that the supply of rich-side mixture is provided to each rich-side flame holes through a common inlet port, it is required that the flow of rich-side mixture introduced to the common inlet port be properly split to three flow lines, respectively, to middle position, to right-hand side position and to left-hand position. To this end, the applicant of the present invention has devised a flow splitting structure. In accordance with this flow splitting structure, the lower end of a formation member for rich-side flame holes situated in the middle is projected, as a projecting part, into the inside of a rich-side mixture introduction channel which extends from the common inlet port. And, the projecting part is provided with a first communication hole. On the other hand, a second and a third communication hole are provided in a wall forming the rich-side mixture introduction channel. And, the flow of rich-side mixture is split into three flow lines, respectively, to the centrally-situated rich-side flame holes through the first communication hole, to the outer rich-side flame holes on the left-hand side through the second communication hole and to the outer rich-side flame holes on the right-hand side through the third communication hole. However, if, as described above, it is arranged that three different types of communication holes (i.e., the first, the second and the third communication holes) are formed facing in the direction of the rich-side mixture introduction channel which extends from the common inlet port whereby the flow of rich-side mixture is split and directed to the three different communication holes, this arrangement may cause dust particles (for example, powdery soil and fibrous dust) contained in the air (the outer air) forming a part of the rich-side mixture to adhere and accumulate in each communication hole, depending on the flow state of rich-side mixture. With such adhesion and accumulation of dust particles, the splitting of the flow of rich-side mixture may be impeded. In addition, it can be conceivable that, associated with the occurrence of clogging, the flowing-in of rich-side mixture is impeded, thereby easily resulting in improper ignition and combustion-state destabilization in rich-side flame holes.

In addition, if configured such that fuel gas and air each supplied from one end are mixed together in the interior of a rich-side mixture introduction channel to produce a fuel gas-air mixture wherein the mixture is split into flow lines respectively to a first, a second and a third communication hole, this configuration may cause unevenness especially in mixing state between the flows of rich-side mixture split from the rich-side mixture introduction channel and directed to the first and the second communication holes or may cause occurrence of a bias between one side and the other side due to assembly errors or the like. And, due to the occurrence of these troublesome conditions, it can be conceivable that the retainability of flames at the outer rich-side flame holes on both sides may become worse or the state of combustion may become unstable. Accordingly, the development of technologies for solving these problems has been required.

Therefore, in the case where the flow of rich-side mixture is split into flow lines respectively to the first, the second and the third communication holes whereby to provide the supply of rich-side mixture to three different positions (i.e., the centrally-situated rich-side flame holes, the outer rich-side flame holes on one side and the outer rich-side flame holes on the other side), the technical problem to be solved is to provide positive assurance that the rich-side mixture is supplied to the rich-side flame holes at each of the three positions whereby to make it possible to improve the stability of combustion. More specifically, the concrete technical problems to be solved are as follows: in the first place, adhesion and accumulation of minute foreign substance such as dust particles in each communication hole is avoided and, in addition, each rich-side flame hole is prevented from becoming clogged due to minute foreign substance such as dust particles and, in the second place, it is required to provide evenness in the state of mixing as well as in the amount to be supplied between the flows of rich-side mixture supplied to the outer rich-side flame holes on both sides.

Solution to Problem

According to a first aspect of the present invention, there is provided a rich-lean combustion burner that comprises: (a) one row of central rich-side flame holes arranged such that it extends longitudinally in the middle of the rich-lean combustion burner; (b) two rows of lean-side flame holes arranged such that they sandwich therebetween the central rich-side flame hole row from both lateral sides thereof; and (c) two rows of outer rich-side flame holes arranged such that they sandwich therebetween both the two lean-side flame hole rows from the outsides thereof, wherein, for split-flow supplying of rich-side mixture from a common rich-side mixture introduction channel, the flow of rich-side mixture is split and supplied to the central rich-side flame hole row and the two outer rich-side flame hole rows. And the rich-lean combustion burner in accordance with the first aspect has the following specific particulars. That is, in the rich-lean combustion burner of the first aspect: (i) a lower end part of a formation member used to form by partition a rich-side mixture supply channel for supplying of rich-side mixture to the central rich-side flame holes is disposed so as to project, as a projecting part, into the inside of the rich-side mixture introduction channel, and a first communication hole for split-flow supplying of rich-side mixture to the rich-side mixture supply channel from the rich-side mixture introduction channel is formed in the projecting part, with its opening oriented to face the interior of the rich-side mixture introduction channel; (ii) in addition, a second and a third communication holes for split-flow supplying of rich-side mixture to the two outer rich-side flame hole rows from the rich-side mixture introduction channel are formed in a formation member used to form by partition the rich-side mixture introduction channel, with their openings oriented to face the interior of the rich-side mixture introduction channel; and (iii) the first communication hole is disposed, with its opening situated upstream, relative to the direction of the flow of rich-side mixture in the inside of the rich-side mixture introduction channel, of where the second and the third communication holes are opened.

Owing to the rich-lean combustion burner of the first aspect, it is facilitated that, even when dust particles are contained in the air making up a part of the rich-side mixture in the inside of the rich-side mixture introduction channel, such dust particles join the flow of rich-side mixture and pass by in front of the first communication hole and then flow downward, whereby the possibility of adhesion and accumulation of dust particles in the first communication hole is reduced to a further extent, when compared to the second and the third communication holes. In particular, owing to the positional setting that allows the first communication hole to open in a direction orthogonal to the direction of the flow of rich-side mixture in the projecting part, it becomes possible to force dust particles to more smoothly pass by in front of the first communication hole, whereby the possibility of adhesion and accumulation of dust particles in the first communication hole is further strongly avoided. Owing to the above, it is possible to avoid, for example, the occurrence of deterioration and destabilization in the state of combustion or ignition failure caused when the supplying of rich-side mixture is interrupted, whereby it becomes possible to accomplish improvements in the stability of combustion.

In the rich-lean combustion burner according to the first aspect, the first communication hole has a smaller opening area than the second or the third communication hole. This will achieve greater effectiveness. In other words, although the greater the opening area, the greater will be the influence of the occurrence of inconvenience due to adhesion and accumulation of dust particles. However, since the first communication hole of less opening area is disposed upstream of the second and the third communication holes of larger opening area, this arrangement provides further positive assurance that the possibility of adhesion and accumulation of dust particles in the first communication hole is avoided without failing. In addition, the case where the first communication hole becomes smaller in opening area than the second or the third communication hole takes place if the following setting is employed. In other words, such a case takes place when the ratio of the opening area of the second and the third communication holes to the opening area of the first communication hole is set corresponding to the ratio of the opening area of the rich-side flame holes in the two outer rich-side flame hole rows to the opening area of the rich-side flame holes in the central rich-side flame hole row. Stated in another way, that is, to put it in a simplest manner, if (i) the opening area of each rich-side flame hole and the opening area of each communication hole are set equal to each other, (ii) there is provided a single second communication hole and there is provided a single third communication hole and (iii) there are provided two first communication holes in total one of which is formed in one side surface of the projecting part and the other of which is formed in the other side surface, the opening area of each first communication hole is half of that of the second or the third communication hole. Even when such a configuration is employed, the influence of the occurrence of troublesome conditions due to adhesion and accumulation of dust particles in the first communication hole can be reduced to a further extent.

In addition, in the rich-lean combustion burner according to the first aspect, it may be arranged that the second and the third communication holes are disposed so as to leave an inner space on the side of a closed end of the rich-side mixture introduction channel which is downstream, relative to the direction of the flow of rich-side mixture in the inside of the rich-side mixture introduction channel, of the openings of the second and the third communication holes. Owing to such an arrangement, even when dust particles are contained in the flow of rich-side mixture in the inside of the rich-side mixture introduction channel, such dust particles are collected and confined in the inner space part, thereby making it possible to inhibit dust particles from flowing in towards the outer rich-side flame holes via the second and the third communication holes. To sum up, it is arranged that the inner space part for holding dust particles contained in the rich-side mixture is formed downstream of the second and the third communication holes.

According to a second aspect of the present invention, there is provided a rich-lean combustion burner that comprises: (a) one row of central rich-side flame holes arranged such that it extends longitudinally in the middle of the rich-lean combustion burner; (b) two rows of lean-side flame holes arranged such that they sandwich therebetween the central rich-side flame hole row from both lateral sides thereof; and (c) two rows of outer rich-side flame holes arranged such that they sandwich therebetween both the two lean-side flame hole rows from the outsides thereof, wherein, for split-flow supplying of rich-side mixture from a common rich-side mixture introduction channel, the flow of rich-side mixture is split and supplied to the central rich-side flame hole row and the two outer rich-side flame hole rows. And the rich-lean combustion burner in accordance with the second aspect has the following specific particulars. That is, in the rich-lean combustion burner of the second aspect: (i) a lower end part of a formation member used to form by partition a rich-side mixture supply channel for supplying of rich-side mixture to the central rich-side flame holes is disposed so as to project, as a projecting part, into the inside of the rich-side mixture introduction channel, and a first communication hole for split-flow supplying of rich-side mixture to the rich-side mixture supply channel from the rich-side mixture introduction channel is formed in the projecting part, with its opening oriented to face the interior of the rich-side mixture introduction channel; (ii) in addition, a second and a third communication holes for split-flow supplying of rich-side mixture to the two outer rich-side flame hole rows from the rich-side mixture introduction channel are formed in a formation member used to form by partition the rich-side mixture introduction channel, with their openings oriented to face the interior of the rich-side mixture introduction channel; and (iii) the second and the third communication holes are disposed so as to face each other without any obstruction, other than a space in the inside of the rich-side mixture introduction channel, therebetween.

In accordance with the rich-lean combustion burner of the second aspect, there exists no obstruction between the second communication hole and the third communication hole. That is, the second communication hole and the third communication hole are situated in an opposite relation to each other without any obstruction, other than a space in the inside of the rich-side mixture introduction channel, therebetween, whereby it is ensured that the occurrence of troublesome conditions which may take place when there is an obstruction between the second communication hole and the third communication hole is positively avoided. Stated in another way, in the case where there is an obstruction (for example, a wall) between the second and the third communication holes, the channel space of the rich-side mixture introduction channel is placed in a state of approximately being partitioned between the second communication hole and the third communication hole. Accordingly, the flow of rich-side mixture flowing through the rich-side mixture introduction channel is divided even though the mixing of rich-side mixture is being insufficient, and reaches the second and the third communication holes while still remaining in such a divided state. As a result, there is the possibility that the rich-side mixture not mixed sufficiently may flow into the second and the third communication holes. And, if the state of mixing remains insufficient, this will cause troublesome conditions. That is, the outer rich-side flame hole rows on both sides are provided with rich-side mixture in different concentrations and amounts. The present rich-lean combustion burner provides positive assurance that the possibility that such troublesome conditions may take place is avoided, whereby the common rich-side mixture present in the common space of the rich-side mixture introduction channel defined between the second and the third communication holes, i.e., the rich-side mixture is split and directed to the second and the third communication holes so that the rich-side mixture supplied to the former is in the same mixing state as that supplied to the latter. This makes it possible that the rich-side mixture supplied to the rich-side flame hole row on one side and that supplied to the rich-side flame hole row on the other side are the same in mixing state and amount.

In the rich-lean combustion burner according to the second aspect, it may be arranged that the lower end part of the formation member used to form by partition the rich-side mixture supply channel is provided, at a position which is other than where the projecting part provided with the first communication hole is positioned and at which the second and the third communication holes are placed in an opposite relation to each other, with a notched concave portion. Regardless of the placement of the formation part used to form by partition the rich-side mixture supply channel or the like, such an arrangement provides positive assurance that, owing to the provision of the notched concave part, the second and the third communication holes are placed in an opposite relation to each other without any obstruction, other than a space in the inside of the rich-side mixture introduction channel, between the second and the third communication holes.

In addition, in the rich-lean combustion burner according to the second aspect, it may be arranged that the formation member used to form by partition the rich-side mixture supply channel is provided by folding, along a fold line position, a single sheet of plate material in a developed state which comprises, on both sides of the plate material sheet across the fold line position, a pair of plate parts used to form by partition the rich-side mixture supply channel so that the plate parts are in an opposite relation to each other, and in addition that a front end side portion of a lower end part of the formation member along the fold line position after the aforesaid folding process serves as the projecting part projecting into the inside of the rich-side mixture introduction channel while, in order that the notched concave part is formed adjacent to the projecting part after said folding process, a notched opening is pre-formed across the fold line when the formation member is in the developed state. Owing to such an arrangement, the lower end part of the formation member is formed by a lower end part after folding along the fold line position, whereby to achieve a state that reliably secures sealability while, by the formation of the notched concave part by the notched opening, it is ensured that the second and the third communication holes are arranged in an opposite relation to each other, without any obstruction, other than the presence of a space, between the second and the third communication holes.

Furthermore, in the present rich-lean combustion burner, it may be arranged that it is configured that it is configured that the flow of lean-side mixture introduced from a common lean-side mixture introduction channel is split and supplied to the two lean-side flame hole rows, and that a rear end side portion of the lower end part of the formation member formed by folding of the plate material sheet is disposed so as to pass transversely across a channel space of the lean-side mixture introduction channel at the split flow position, and in addition wherein the rear end side portion is disposed so as to incline obliquely upward towards the downstream side of the flow of lean-side mixture. Owing to such an arrangement, the rich-side mixture supply channel to be formed by partition in the inside of the formation member and the lean-side mixture introduction channel are reliably shut off from each other, whereby to maintain a state that provides high-level sealability. With this, in particular, the rear end side portion of the lower end part of the formation member is disposed so as to incline obliquely upward toward the downstream side of the flow of lean-side mixture, whereby to increase the distance during which the lean-side mixture is mixed in the inside of the lean-side mixture introduction channel so as to enhance the mixing level of lean-side mixture, thereby making it possible to supply the lean-side mixture, the mixing level of which has been enhanced to a higher level, to the lean-side flame holes.

If a combustion apparatus comprises any one of the rich-lean combustion burners as set forth above, this makes it possible for the combustion apparatus to provide the same advantageous effects that the combustion apparatus does.

BRIEF DESCRIPTION OF DRAWINGS

In the drawings:

FIG. 1, comprised of FIG. 1(*a*) and FIG. 1(*b*), shows an example of a combustion apparatus into which a rich-lean combustion burner according to the present invention is incorporated, wherein FIG. 1(*a*) is an illustration diagram showing a perspective view of the combustion apparatus and FIG. 1(*b*) is an illustration diagram showing a cross-sectional view of the combustion apparatus;

FIG. 3 is comprised of FIGS. 3(*a*), 3(*b*), wherein FIG. 3(*a*) is a top plan view of the burner of FIG. 2 and FIG. 3(*b*) is a partially enlarged view of an F-F section of FIG. 3(*a*);

DESCRIPTION OF EMBODIMENTS

Figure 2:
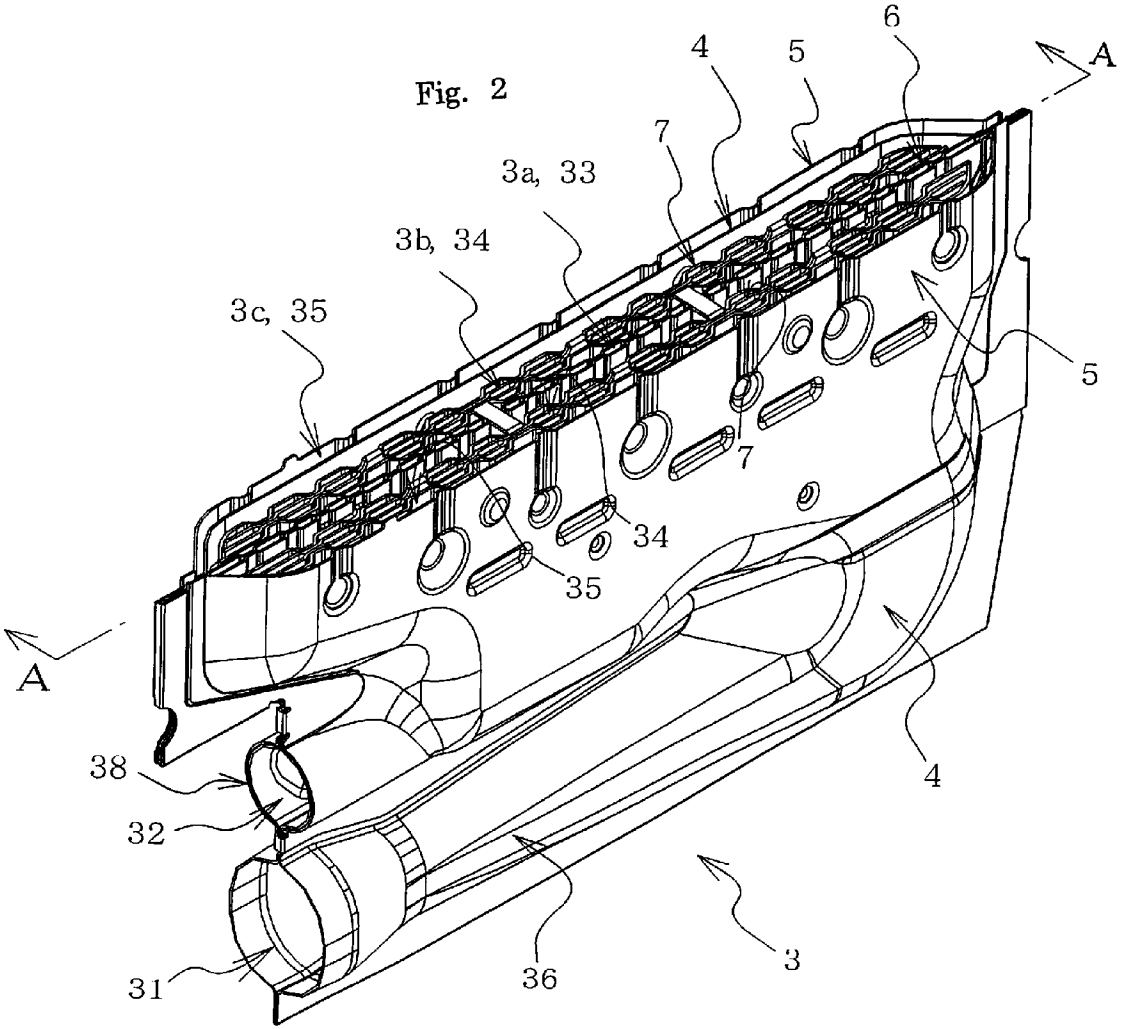
FIG. 2 is a perspective view of a rich-lean combustion burner according to an embodiment of the present invention.

Hereinafter, embodiments of the present invention will be described with reference to the drawing figures.

FIG. 1 shows a combustion apparatus 2 into which a rich-lean combustion burner according to an embodiment of the present invention is incorporated. The combustion apparatus 2 includes a can body 21 in which a set of burners, made up of a predetermined number of rich-lean combustion burners 3, 3, . . . which are laterally adjacently arranged, is firmly fixed. The can body 21 includes an upper space serving as a combustion space 22 and a lower space 23 to which combustion air from an air distribution fan 24 is supplied. One side of a rich-lean combustion burner 3 is provided with a gas manifold 25 which is shown only in FIG. 1(*b*), and two gas nozzles 26, 27 are projected from the gas manifold 25 to the rich-lean combustion burner 3. One of the gas nozzles (the lower one), i.e., the gas nozzle 26, is configured to discharge fuel gas in the direction of a first supply port 31 of the rich-lean combustion burner 3 while on the other hand the other of the gas nozzles (the upper one), i.e., the gas nozzle 27, is configured to discharge fuel gas in the direction of a second supply port 32 of the rich-lean combustion burner 3. And, air from the lower space 23 is forced in from around each gas nozzle 26, 27 by discharge pressure of the air distribution fan 24 so that both fuel gas and air are supplied to the first and the second supply ports 31, 32. In this case, it is arranged such that the diameter of the first supply port 31 is set considerably larger than the outer diameter of the gas nozzle 26 so that much more air is forced in while on the other hand the diameter of the second supply port 32 is set larger than the outer diameter of the gas nozzle 27 to thereby reduce the amount of air to be forced in. In this way as described above, in addition to the supply of fuel gas, the first supply port 31 supplies an amount of air to the inside so as to provide a predetermined air ratio that the amount of air supplied is more than one times the amount of fuel gas supplied. On the other hand, in addition to the supply of fuel gas, the second supply port 32 supplies an amount of air to the inside so as to provide a predetermined air ratio that the amount of air supplied is less than one times the amount of fuel gas supplied. In addition, there is disposed a current plate 28 (see FIG. 1(*b*)) serving as a partition between the lower space 23 and the rich-lean combustion burners 3, 3, . . . and there are opened through the current plate 28 a great number of small bores, whereby secondary air is supplied between rich-lean combustion burner 3, 3 adjacent to each other through these small bores.

As shown in FIG. 2, the rich-lean combustion burner 3 is formed by processing a metallic plate into a predetermined shape by means of stamping process and bending work. The rich-lean combustion burner 3 is provided with a central rich-side burner part 3*a* composed of a single rich-side flame hole row 33, a lean-side burner part 3*b* composed of two lean-side flame hole rows 34, 34 and an outer rich-side burner part 3*c* composed of two rich-side flame hole rows 35, 35. The rich-lean combustion burner 3 is formed having a flattened shape as a whole and these are formed using three different types of plate members (i.e., plate members 4, 4, 5, 5, 6) and a pair of flame hole formation members 7, 7. That is, the rich-lean combustion burner 3 is formed as follows. That is, the one pair of the first plate members 4, 4 and the one pair of the second plate members 5, 5, the single third plate member 6 and the one pair of the flame hole formation members 7, 7 are used and the first plate members 4, 4 and the second plate members 5, 5 are placed one upon the other as will be described hereinafter, with the third plate member 6 (centrally situated relative to the width direction, i.e., the direction in which thickness is defined) interposed therebetween. Here, if assumed that the top-bottom direction of FIG. 3(*a*) is taken as the longitudinal direction (the front-back direction) while the horizontal direction of FIG. 3(*a*) is taken as the lateral direction (the horizontal width direction), the first supply port 31 is opened at a lower side position on one longitudinal side while the second supply port 32 having a smaller diameter than the first supply port 31 is opened at an upper side position, and rows of flame holes where combustion flames are produced are formed in an upper end surface so as to extend in the longitudinal direction, as shown in FIG. 3. As can bee seen from FIGS. 3 (*a*), (*b*), there are shown flame hole rows. More specifically, the single rich-side flame hole row 33 formed at narrow width lies centrally relative to the lateral central and extends for the entire longitudinal length of the burner 3, and the lean-side flame hole rows 34, 34 formed at relatively wide width lie respectively on either lateral side of the rich-side flame hole row 33 and extend for the entire longitudinal length of the burner 3 and the two rich-side flame hole rows 35, 35 formed at narrow width lie respectively on the outsides of the lean-side flame hole rows 34, 34 and extend for the entire longitudinal length. And, a lean-side mixture, resulting from internal mixing after it was supplied from the first supply port 31 (see FIG. 2), is directed to lean-side flame holes 341 of the lean-side flame hole rows 34, 34, and lean-side flames are produced by the lean-side mixture. On the other hand, a rich-side mixture, resulting from internal mixing after it was supplied from the second supply port 32 (see FIG. 2), is directed to each rich-side flame hole 331 of the centrally-situated rich-side flame hole row 33 and to each rich-side flame hole 351 of the two rich-side flame hole rows 35, 35 on the outsides, and rich-side flames are produced by the rich-side mixture.

Figure 4:
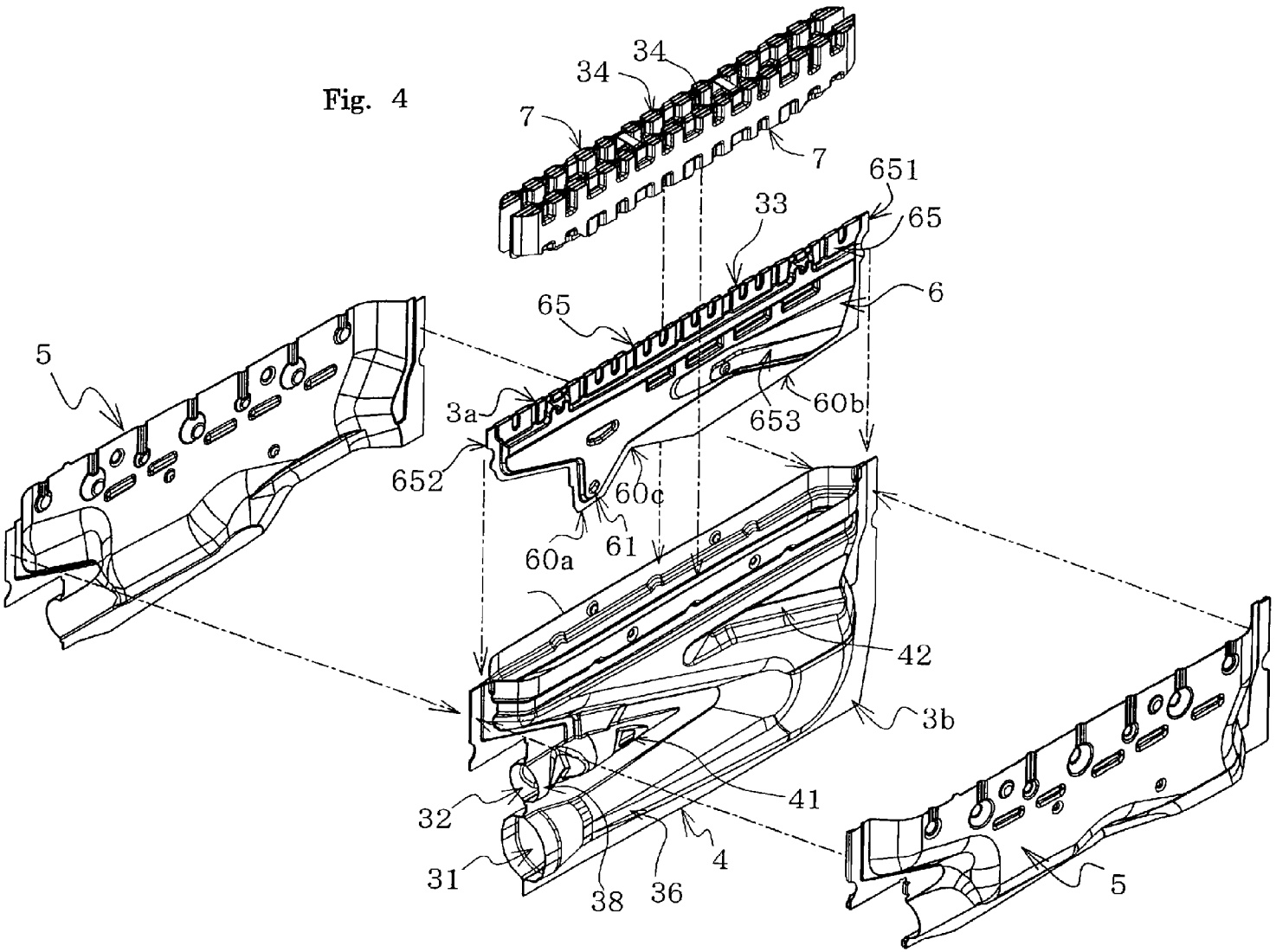
FIG. 4 is a perspective view showing, in an exploded manner, a third plate member constituting a central rich-side burner part, a flame hole member constituting lean-side flame hole rows disposed respectively on either side of the central rich-side burner part, a second plate member and a first plate member.

For example, the rich-lean combustion burner 3 as described above is formed as follows. As shown in FIG. 4, three different types of plate members 4, 4, 5, 5, 6 and a pair of flame hole formation members 7, 7 are used to make up a rich-lean combustion burner 3. The third plate member 6 (see FIG. 5) is formed as follows. A thin plate material is provided which is stamped into a plate member 6*a* in the form of a single sheet so that a plate part 65 serving as one side surface and another plate part 65 serving as the other side surface (these side surfaces are subsequently to be in an opposite relation to each other) are placed in a state that they are in an axisymmetric arrangement across a fold line T. Then, the plate member 6*a* after stamping process is folded inward (in the direction indicated by alternate long and short dash line) with the fold line T serving as a center so that both the plate parts 65, 65 are situated face to face with each other, whereby rear end edges 651, 651 (front end edges 652, 652) are brought into close contact with each other. After the plate member 6*a* is folded, fold portions along the fold line T become lower end parts 60*a*, 60*b*. The plate parts 65, 65 extending upward from the lower end parts 60*a*, 60*b* face each other with a predetermined narrow interval left between the plate parts 65, 65. There is defined between their inner surfaces a rich-side mixture supply channel in fluid communication with the rich-side flame hole row 33 at the upper end surface (see also FIG. 4). In addition, along the fold line T in the lower end part 60*a* on the front end side, first communication holes 61, 61 are formed through the plate parts 65, 65, respectively. And, in the plate member 6*a* in a developed state (see FIG. 5), a notched opening 601 approximately shaped like a rhomboid is pre-formed on the rear side of the first communication holes 61, 61 across the fold line T. And, a notched concave part 60*c* (see also FIG. 4) is formed when the plate member 6*a* is folded. In this way, the third plate member 6 forms a central rich-side burner part 3*a*. In addition, as a notched opening for forming the notched concave part 60*c*, various shapes other than approximate rhomboid, such as rectangle, circle, elongated circle and polygon, may be employed.

And, the central rich-side burner part 3*a* (see FIG. 4) is inserted inside into a space defined between the one pair of the first plate members 4, 4 from above so that the one pair of the first plate members 4, 4 are situated face to face with each other from both lateral sides, with the central rich-side burner part 3*a* interposed therebetween. Next, the flame hole formation members 7, 7 are placed respectively within an upper end opening defined between the first plate member 4 on one side and the central rich-side burner part 3*a* and within an upper end opening defined between the first plate member 4 on the other side and the central rich-side burner part 3*a*. This forms a lean-side burner part 3*b*, by which lean-side flames are produced in the two lean-side flame hole rows 34, 34 (see also FIG. 3) at the upper end surface, with the central rich-side burner part 3*a* enclosed from both lateral sides. And, the second plate member 5 is covered on the outside of each first plate member 4 of the lean-side burner part 3 whereby to form the outer rich-side flame hole rows 35, 35 (see FIG. 3) at the upper end side. This forms by partition a supply channel, through which the supply of rich-side mixture is provided to each rich-side flame hole row 35, between the inner surface of each second plate member 5 and its opposing outer surface of the first plate member 4 whereby to form an outer rich-side burner part 3*c* (see FIG. 2 and FIG. 3).

Figure 6:
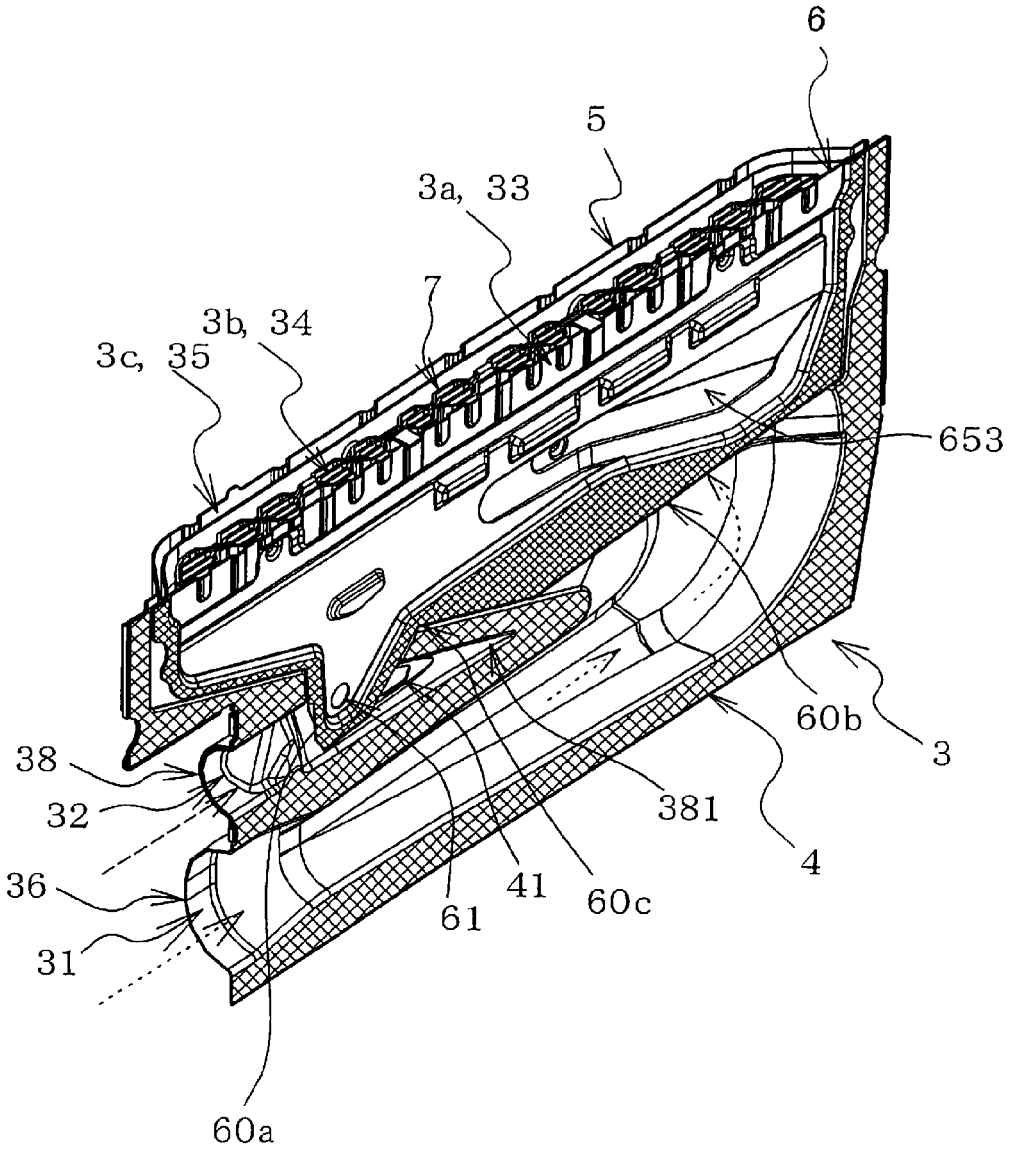
FIG. 6 is a perspective view depicting a state as taken along line A-A of FIG. 2.
Figure 7:
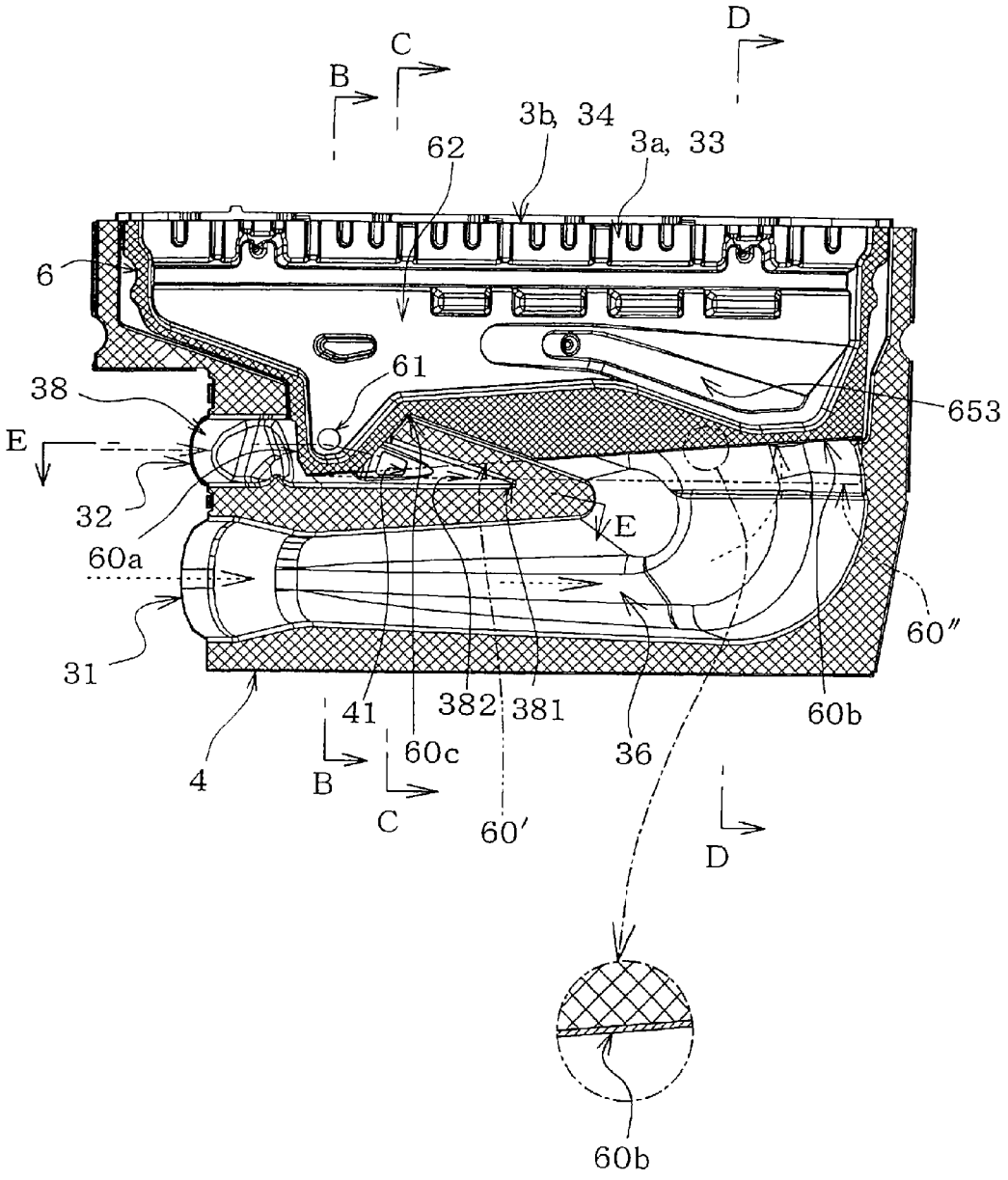
FIG. 7 is a front view depicting a state as taken along line A-A of FIG. 2.
Figure 8:
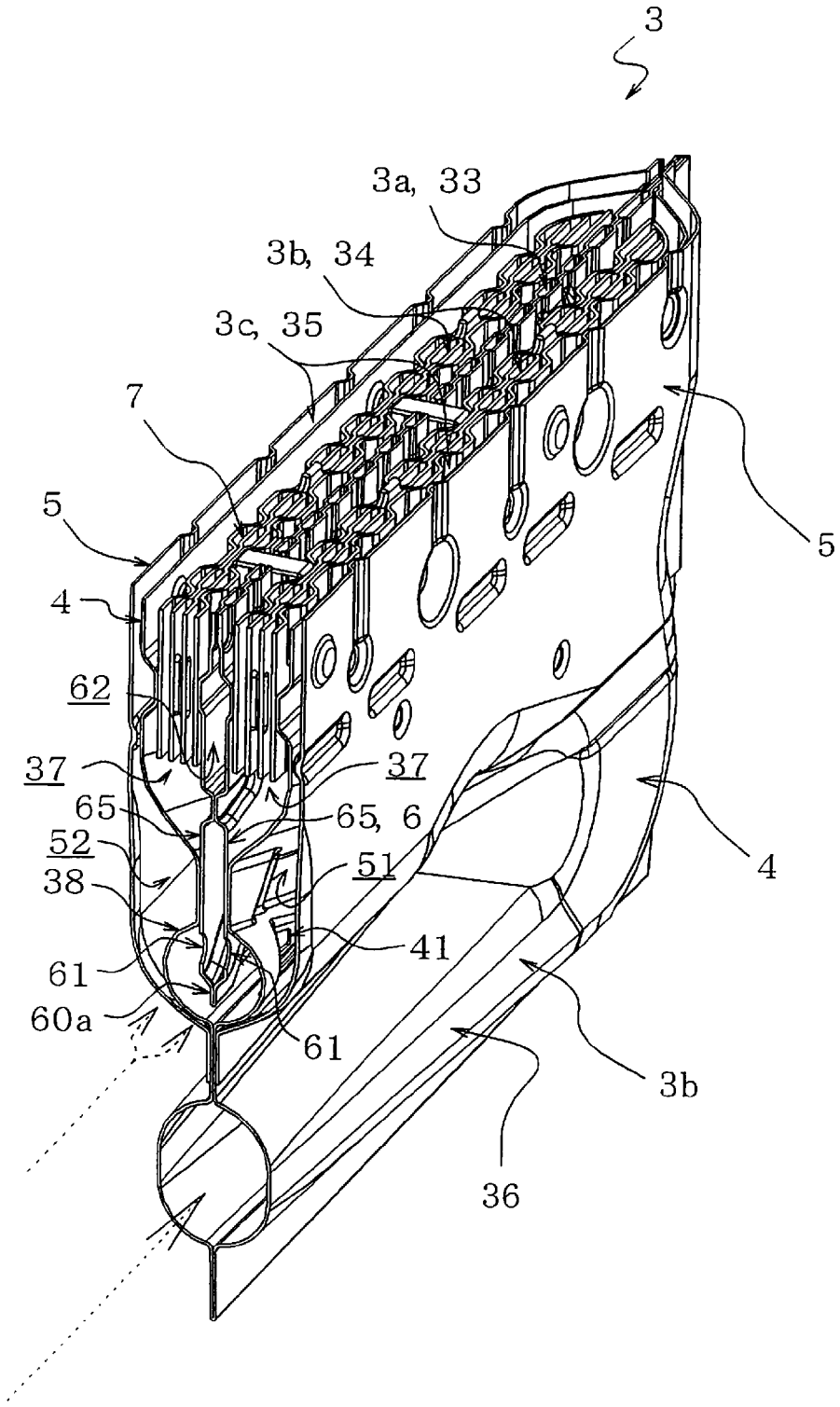
FIG. 8 is a partial perspective view of the rich-lean combustion burner as cut at a position corresponding to line B-B of FIG. 7.

Next, referring now to FIGS. 6, 7, a description will be given in regard to a mixture supply structural portion. In addition, note that portions indicated by mesh-like hatching in FIGS. 6, 7 are joint surfaces. These joint surfaces are closely jointed together by close contact or by press contact and are maintained in a further closely jointed state by liner welding or by spot welding. In the interior of a tubular part 36 of the lean-side burner part 3*b*, fuel gas and air each supplied from the first supply port 31 which is opened on one side are mixed together into a lean-side mixture. The lean-side mixture is fed to the other side through the tubular part 36 (see a dotted arrow in FIGS. 8 and 9). Then, at the other side, the lean-side mixture changes its direction to flow upward and is fed, via two inner spaces 37, 37, to each lean-side flame hole row 34 at the upper end (see FIG. 10). These two inner spaces 37, 37 are spaces formed by partition (division) of a space which is defined between the one pair of the first plate members 4, 4 by the lower end part 60*b* of the third plate member 6. The tubular part 36 and the inner spaces 37, 37 together form a lean-side mixture supply channel through which the supply of lean-side mixture is provided to the two lean-side flame hole rows 34, 34 and in addition, the tubular part 36 serves, for fuel gas and air supplied through the first supply port 31, not only as a mixing chamber but also as an introduction channel (i.e., a lean-side mixture introduction channel). The third plate member 6 constitutes a formation member for forming by partition a first supply channel (to be hereinafter described) and the downstream side of the lean-side mixture introduction channel is halved (divided into two parts) by the third plate member 6, whereby two lean-side mixture supply channels (i.e., the inner spaces 37, 37) are formed by partition.

Figure 11:
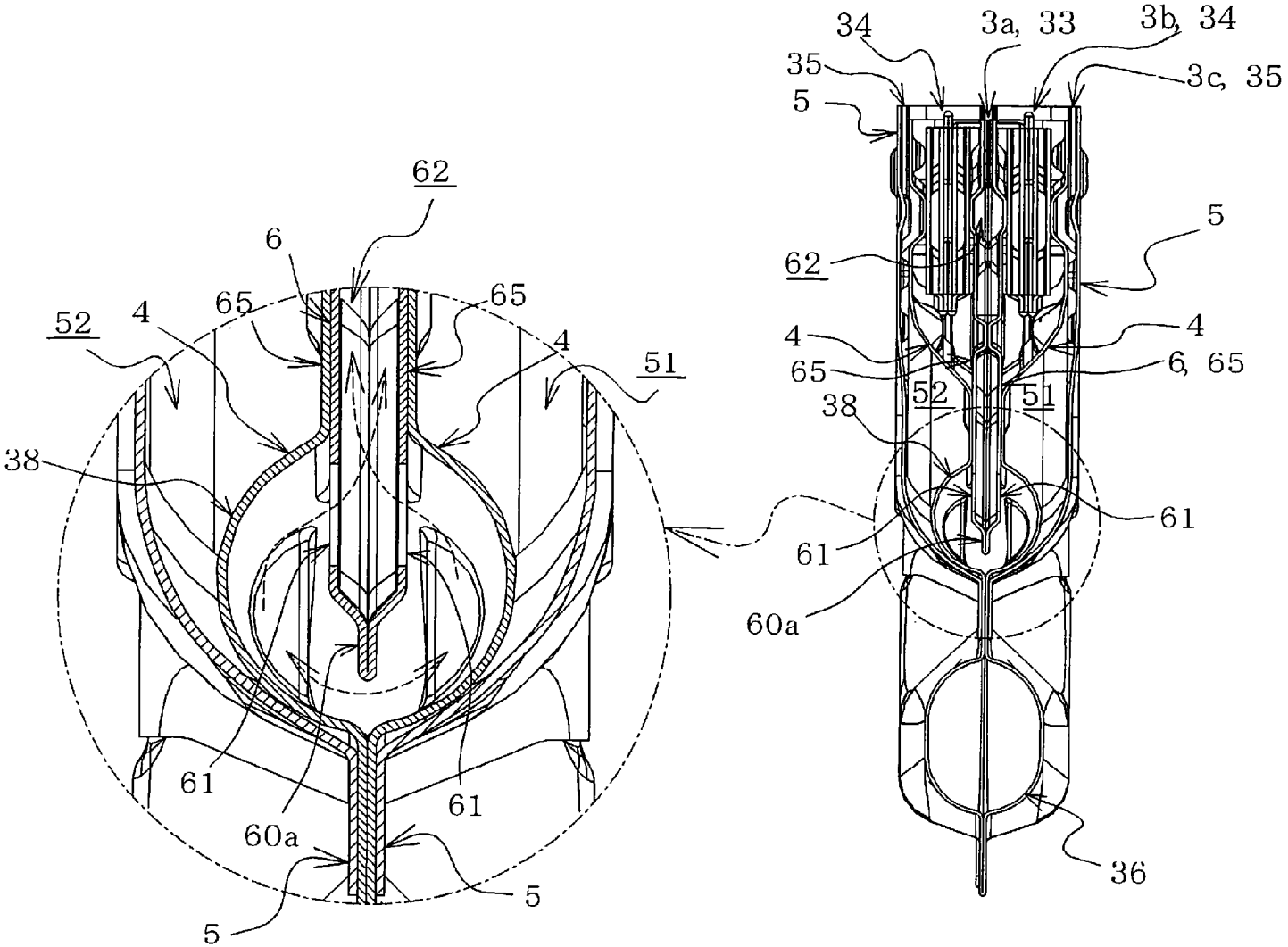
FIG. 11 is a cross-sectional illustration diagram of the rich-lean combustion burner as cut at a position corresponding to line B-B of FIG. 7.

In addition, fuel gas and air supplied to the second supply port 32 on the upstream end side are mixed together in the inside of a tubular part 38 to thereby form a rich-side mixture. The rich-side mixture is subjected to further mixing during the time it is being guided via the tubular part 38 up to a closed end 381 situated at the rear (back), i.e., on the downstream side. And, this rich-side mixture is supplied to the central rich-side burner part 3*a* and to both the outer rich-side burner parts 3*c*. In other words, the lower end part 60*a* of the central rich-side burner part 3*a* on the front end side is inserted from above into the inside of the tubular part 38 so as to be disposed as a projecting part projecting in a suspended state (see also FIG. 11) in the inside of the tubular part 38. In the projecting part (i.e., the lower end part 60*a*), the first communication holes 61, 61 are opened near the upper side (upper position) of a mixing chamber which is an inner space of the tubular part 38, whereby the mixing chamber and the inner space 62 of the central rich-side burner part 3*a* are brought into fluid communication with each other. Owing to this arrangement, the rich-side mixture in the tubular part 38 (see FIGS. 11 and 8) is fed to the rich-side flame hole row 33 through both the first communication holes 61, 61 and then through the inner space 62.

Figure 9:
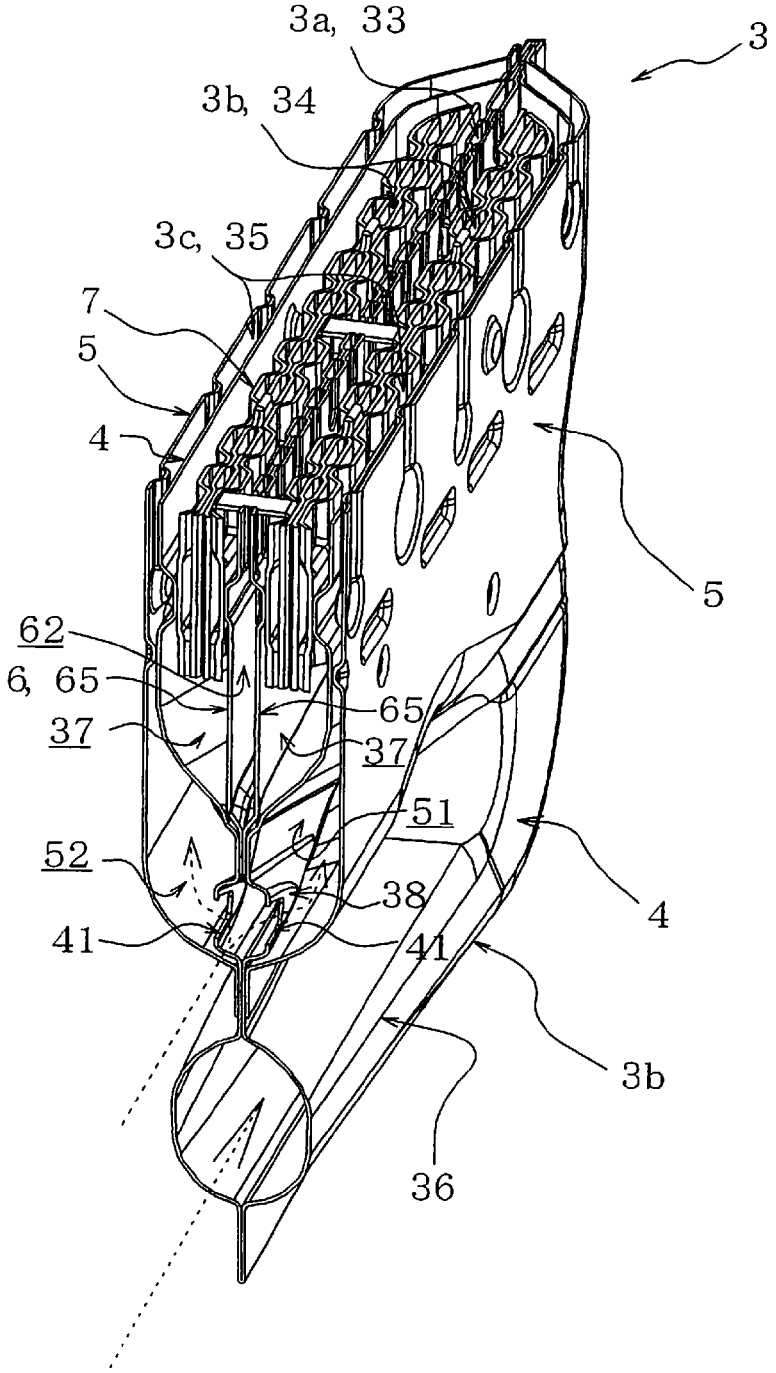
FIG. 9 is a partial perspective view of the rich-lean combustion burner as cut at a position corresponding to line C-C of FIG. 7.
Figure 10:
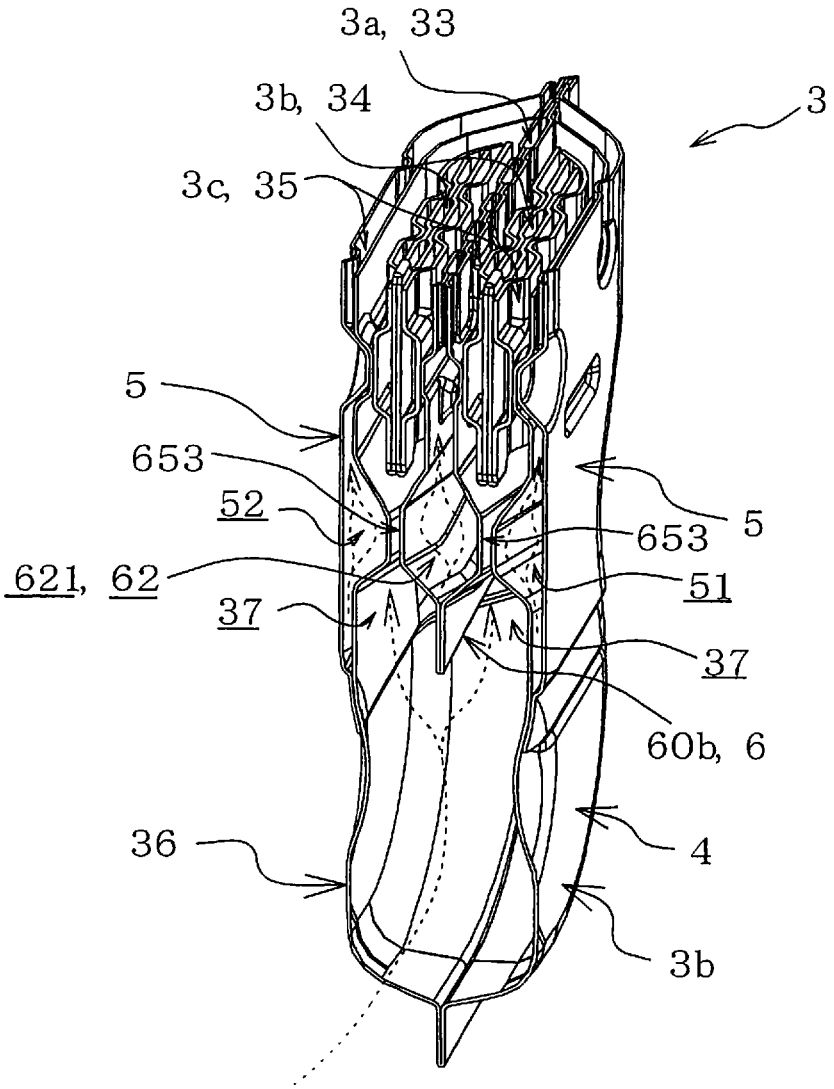
FIG. 10 is a partial perspective view of the rich-lean combustion burner as cut at a position corresponding to line D-D of FIG. 7.
Figure 12:
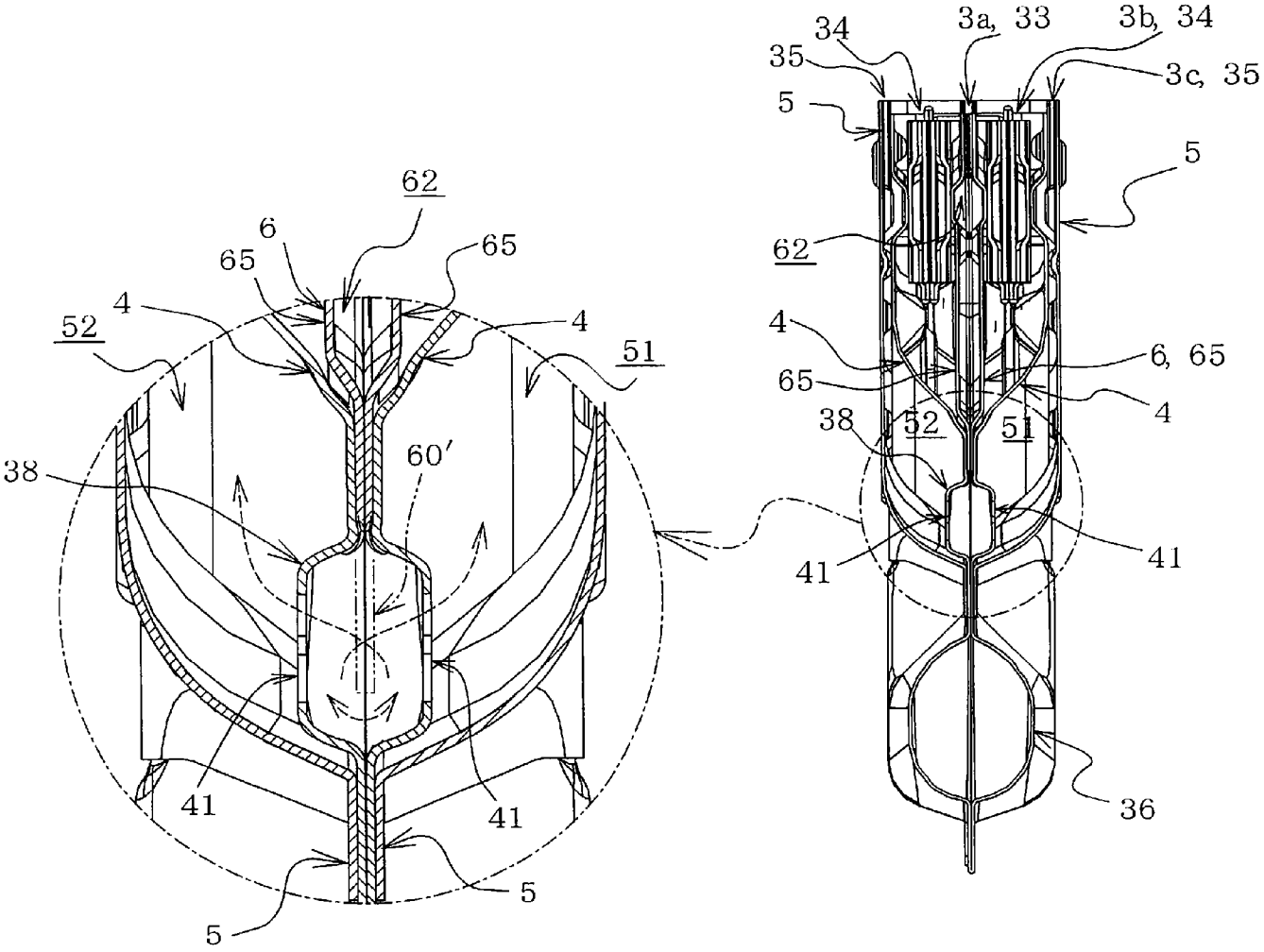
FIG. 12 is a cross-sectional illustration diagram of the rich-lean combustion burner as cut at a position corresponding to line D-D of FIG. 7.

In addition, on the side downstream of where both the first communication holes 61, 61 are opened (i.e., on the side of the closed end 381), a second communication hole 41 and a third communication hole 41 are formed respectively through the one pair of the first plate members 4, 4 constituting the tubular part 38, as shown in FIGS. 9 and 12. Owing to the second communication hole 41 on one side (on the right-hand side in FIG. 9 or FIG. 12), the mixing chamber of the tubular part 38 is brought into fluid communication with an inner space 51 between the first plate member 4 on one side and the second plate member 5 on the same side while, owing to the third communication hole 41 on the other side (on the left-hand side in FIG. 9 or FIG. 12), the mixing chamber in the tubular part 38 is brought into fluid communication with an inner space 52 between the first plate member 4 on the other side and the second plate member 5 on the same side. Because of such arrangement, the supply of rich-side mixture in the tubular part 38 is provided, through the second communication hole 41 and then through the inner space 51, to the rich-side flame hole row 35 on one side, while on the other hand the supply of rich-side mixture in the tubular part 38 is likewise provided, through the third communication hole 41 and then through the inner space 52 on the other side, to the rich-side flame hole row 35 on the other side. In addition, the second communication hole 41 and the third communication hole 41 are arranged such that they are opened so as to face each other in the lateral direction at where the notched concave part 60*c* of the third plate member 6 (see FIG. 7) is positioned, whereby the second and the third communication holes 41, 41 face each other across a space in the tubular part 38 in which there exists no obstruction in the lateral direction (i.e., in the horizontal width direction) between the second and the third communication holes 41, 41, as shown in FIG. 12.

In addition, the tubular part 38 makes up not only a mixing chamber in which to mix fuel gas and air each supplied from the second supply port 32 to thereby form a mixture of fuel gas and air, but also a rich-side mixture introduction channel for introduction of the mixture thus mixed. On the other hand, the internal spaces 51, 51, 62 serve to form rich-side mixture supply channels for providing the supply of rich-side mixture to their corresponding ones of the rich-side flame hole rows 35, 33, 35. To sum up, the one inner space 51 in fluid communication with the second communication hole 41 defines a second rich-side mixture supply channel; the other inner space 52 in fluid communication with the third communication hole 41 defines a third rich-side mixture supply channel; and the inner space 62 in fluid communication with the first communication holes 61, 61 defines a first rich-side mixture supply channel. And, the lower end part 60*a* as a projecting part is projected just so as to allow the first communication holes 61, 61 to come into fluid communication with a space in the inside of the tubular part 38. The lower end edge of the lower end part 60*a* and the inner bottom surface of the tubular part 38 are placed in a state of non-contact with each other and the vertical space therebetween is placed in a state of extension in the lateral direction (i.e., the horizontal width direction in FIG. 8 or FIG. 11) without the presence of obstruction in the lateral direction. The one pair of the first plate members 4, 4 constitute a formation member for forming by partition the rich-side mixture introduction channel Additionally, it is set that the total of the opening areas of the one pair of the first communication holes 61, 61 is equal to the opening area of the second or the third communication hole 41. More specifically, it is arranged that the first communication hole 61 is a small hole that has an opening area corresponding to half of the opening area of the second or the third communication hole 41. This is based on the setting that makes the total of the opening areas in the rich-side flame hole row 33 of the central rich-side burner part 3*a* equal to the total of the opening areas in each of the rich-side flame hole rows 35 of the outer rich-side burner part 3*c*. In other words, it is set that the ratio of the total of the opening areas of the one pair of the first communication holes 61, 61 to the opening area of the second or the third communication hole 41 is equal to the ratio of the opening area of the rich-side flame holes of the centrally-situated rich-side flame hole row 33 to the opening area of the rich-side flame holes of each outer rich-side flame hole row 35. Owing to this setting, the rich-side flame hole rows 33, 35, 35 are each supplied with rich-side mixture in the same amount as the others after the flow was split from the common space of the tubular part 38 into flow lines, respectively, to the first communication holes 61, 61 and the second and the third communication holes 41, 41.

Here, a description will be given in regard to countermeasures against dust particles that may be contained in the air forming a part of the rich-side mixture. As described above, each first communication hole 61 is formed such that it is opened in the space of the tubular part 38 which is a rich-side mixture introduction channel, more specifically, near the upper side (position) thereof. In other words, each first communication hole 61 is formed so as to open at a position above the lower end part 60*a* projecting into the interior of the tubular part 38. Therefore, even when dust particles, which have entered the rich-side mixture introduction channel together with the air constituting a part of the rich-side mixture, remain and accumulate there, the possibility that each first communication hole 61 becomes clogged is reduced because each first communication hole 61 is formed near the upper side of the tubular part 38 which is a rich-side mixture introduction channel. Furthermore, it is set that, in the inside of the tubular part 38 (i.e., the rich-side mixture introduction channel) extending up to the closed end 381 from the second supply port 32 in the front-back direction, each of the first communication holes 61, 61 is positioned so that it is opened at a position upstream, relative to the direction of the flow of rich-side mixture, of the second and the third communication holes 41, 41. This positional setting facilitates that, even in the case where dust particles enter the inside of the tubular part 38 (the rich-side mixture introduction channel) together with the air constituting a part of the rich-side mixture flowing in from the second supply port 32, such a dust containing flow is passed by in front of the first communication holes 61, 61 towards the downstream side (in the direction of the closed end 381). This prevents adhesion and accumulation of duct particles in the first communication holes 61, 61 as much as possible even when they have a smaller opening area than the second or the third communication hole 41. In particular, since the first communication holes 61, 61 are opened so as to face in a direction orthogonal to the direction of the flow of rich-side mixture, the foregoing passing-by can be realized effectively.

Figure 13:
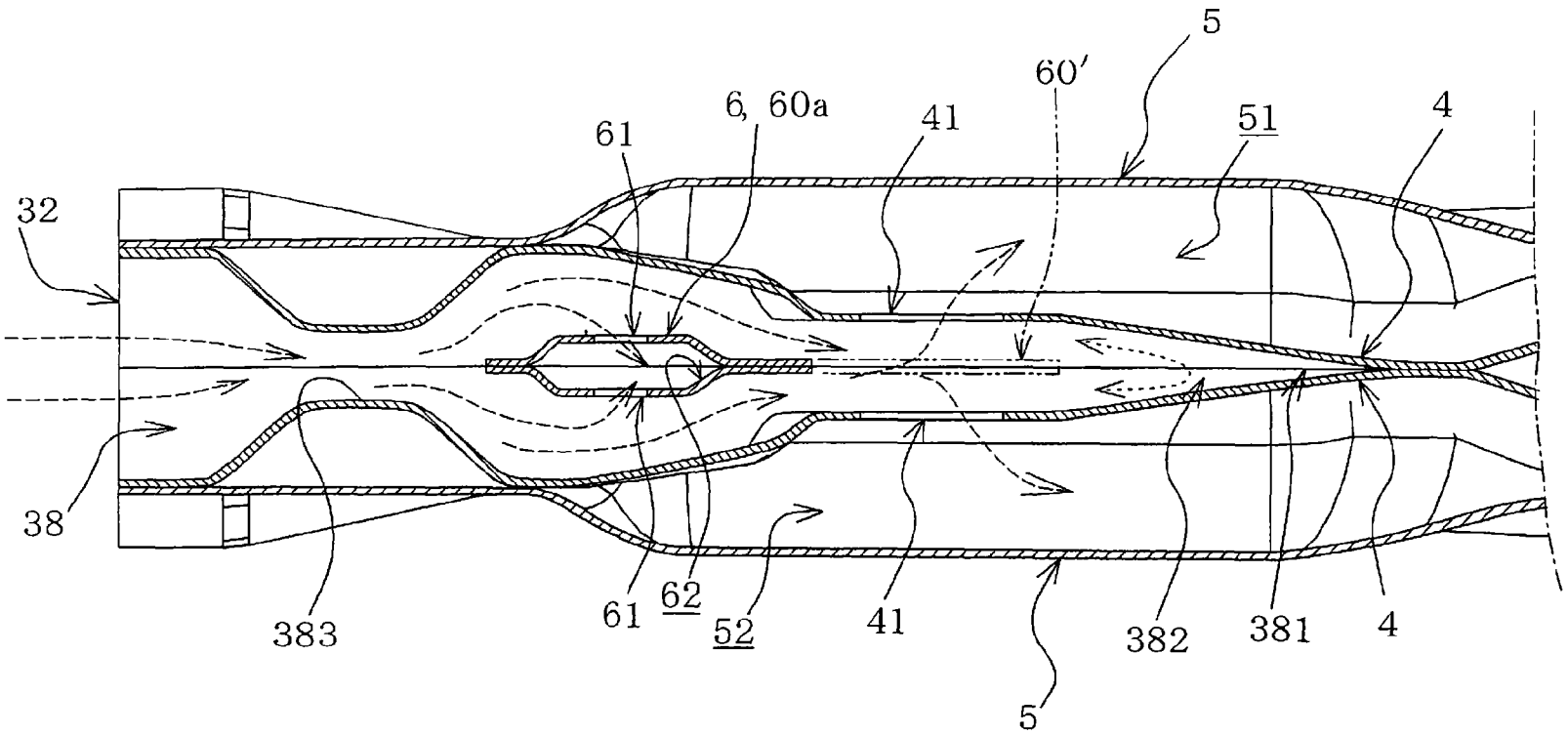
FIG. 13 is a partially enlarged cross-sectional illustration diagram depicting a state as taken along line E-E of FIG. 7.

In addition, it is arranged that a pocket part 382 which is an inner space part configured to collect dust particles (see FIGS. 6, 7 or FIG. 13) is left at a downstream position situated further downstream of the second and the third communication holes 41, 41. That is, the tubular part 38 is formed so that, in the inside of the tubular part 38 which is a rich-side mixture introduction channel, the inner space part exists in a portion of the interior of the tubular part 38 situated downstream of the second and the third communication holes 41, 41 and extending to the closed end 381. Owing to this arrangement, even when dust particles are contained in the rich-side mixture present in the inside of the tubular part 38, such dust particles are collected or captured in the pocket part 382, thereby making it possible to inhibit the flowing-in of dust particles into the inner spaces 51, 52 through the communication holes 41, 41. In addition, note that reference numeral 383 in FIG. 13 denotes a narrowed part formed so as to extend from the second supply port 32 to the first communication holes 61, 61 in the tubular part 38. During passage through the narrowed part 383, the flow of rich-side mixture is disturbed whereby to promote the mixing of fuel gas and air together forming a rich-side mixture.

Figure 5:
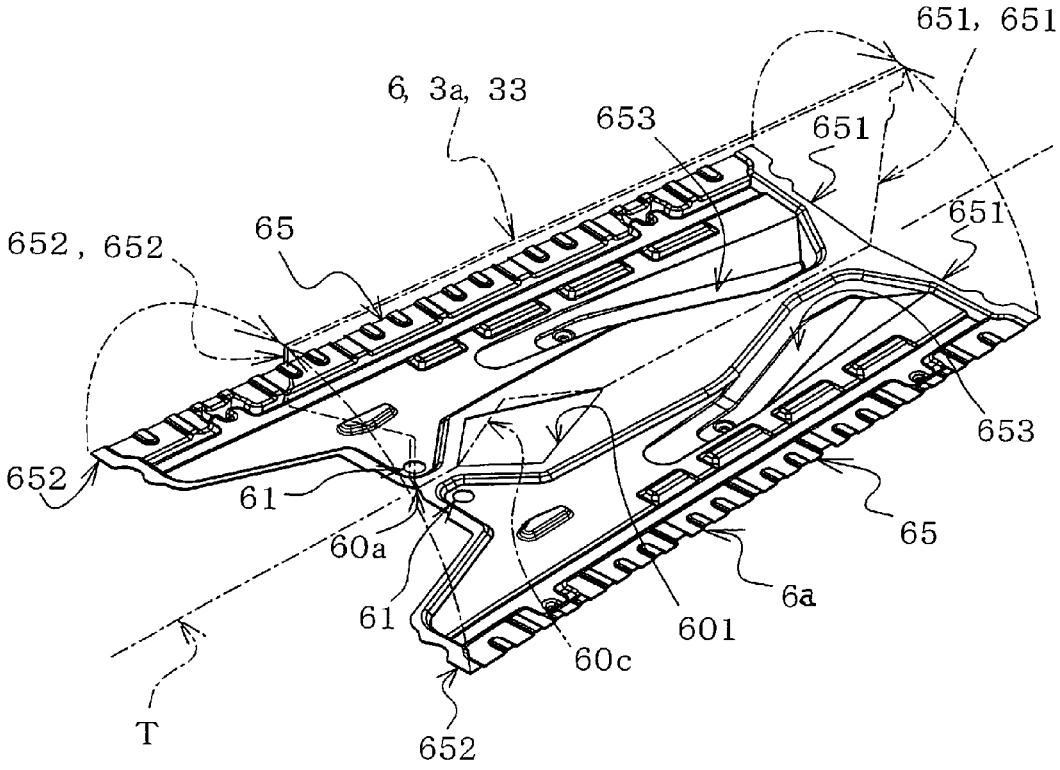
FIG. 5 is a perspective view of the third plate member of FIG. 4 in a developed state.
Figure 14:
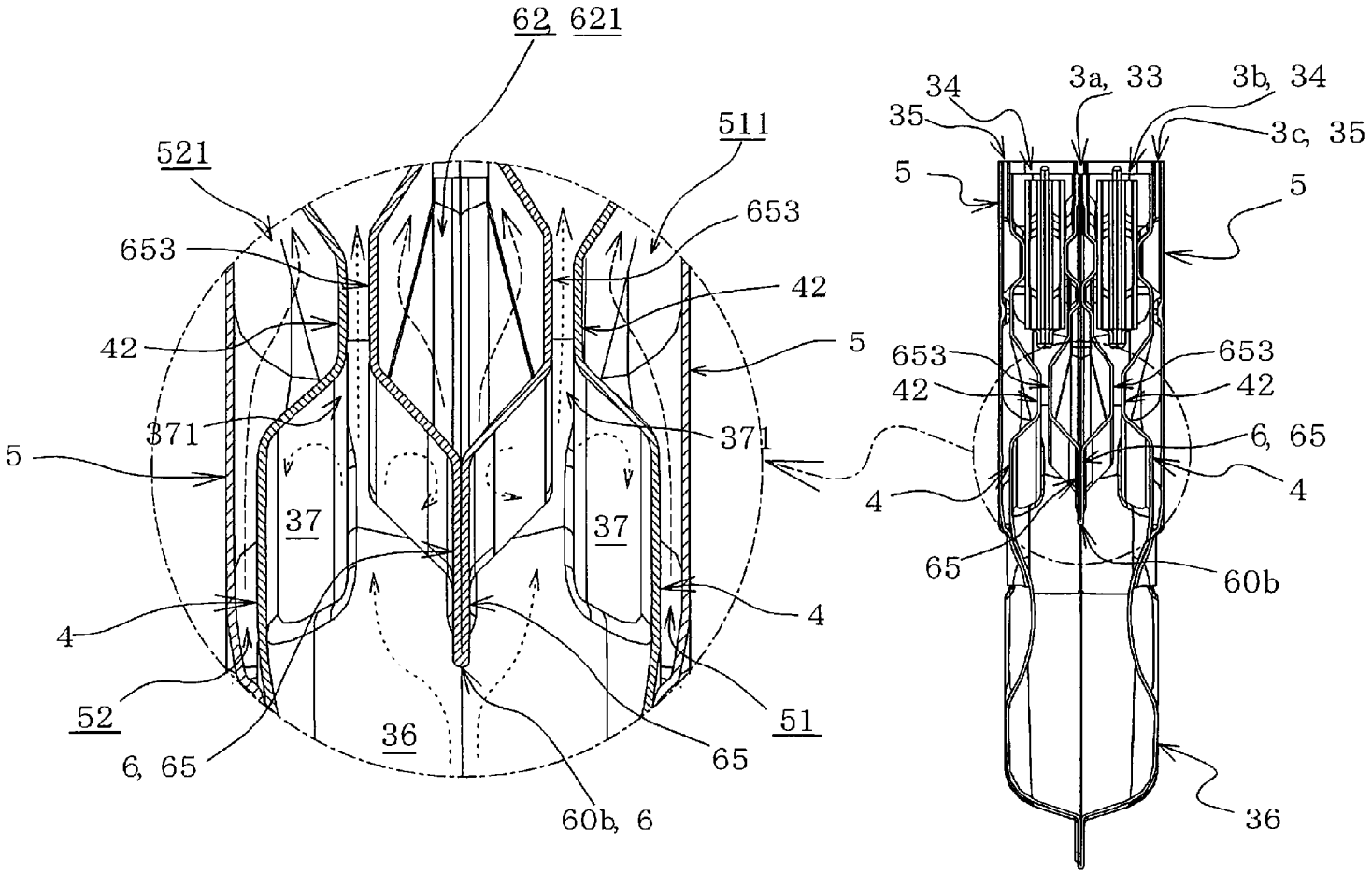
FIG. 14 is a cross-sectional illustration diagram of the rich-lean combustion burner as cut at a position corresponding to line C-C of FIG. 7.

In addition, the plate parts 65, 65 of the third plate member 6 are each provided with a protruding part 653 partially projecting outward in the lateral direction (see FIGS. 4, 5 or FIG. 6). Formed by partition between the one pair of the protruding parts 653, 653 in an opposite relation to each other is a first protruding space 621 (see FIGS. 10, 14). Owing to such arrangement, the first protruding space 61 larger than the rest is interposed somewhere along the inner space 62 which is a rich-side mixture supply channel, whereby to reduce the strength of the flow of rich-side mixture entering the inside of the inner space 62 from the first communication holes 61, 61 and then flowing to the rich-side flame hole row 33. This makes it possible to force dust particles, which have passed through the first communication holes 61, 61 to enter the inside of the inner space 62, to subside and accumulate, whereby each rich-side flame hole 331 of the rich-side flame hole row 33 is prevented from entering into a state of becoming clogged by dust particles.

Furthermore, similar to the plate parts 65, 65, the first plate members 4, 4 are each provided with a protruding part 42 partially projecting inward in the lateral direction (see FIG. 4). A second protruding space 511 and a third protruding space 521 are formed by partition, respectively, between the protruding part 42 of one first plate member 4 and its laterally opposing second plate member 5 and between the protruding part 42 of the other first plate member 4 and its laterally opposing second plate member 5 (see FIGS. 10, 14). Owing to such arrangement, the second (third) protruding space 511 (521) larger than the rest is interposed somewhere along the inner space 51 (52) which is a rich-side mixture supply channel, whereby to reduce the strength of the flow of rich-side mixture entering the inside of the inner space 51 (52) from the second (third) communication hole 41 (41) and then flowing to the rich-side flame hole row 35 (35). This makes it possible to force dust particles, which have passed through the second and the third communication holes 41, 41 to enter the inside of the inner spaces 51, 52, to subside and accumulate, whereby each rich-side flame hole 351 of the outer rich-side flame hole rows 35, 35 is prevented from entering into a state of becoming clogged by dust particles. In particular, even if dust particles accumulate in the space of the pocket part 382 extending to the closed end 381 of the tubular part 38 and overflow into the inner spaces 51, 52 from the second and the third communication holes 41, 41, it is still possible to bring the dust particles to subside and accumulate in the second and the third protruding spaces 511, 521 before arrival at each rich-side flame hole 351 of the rich-side flame hole rows 35, 35. This provides positive assurance that each rich-side flame hole 351 is prevented from clogging due to dust particles.

Next, a description will be given in regard to measures to improve the mixing state of rich-side mixture which is so split into two flow lines at the second and the third communication holes 41, 41 as to be supplied to the two outer rich-side flame hole rows 35, 35. As has been described above, the second and the third communication holes 41, 41 are opened so as to face each other in the lateral direction in the space in the inside of the tubular part 38 where the notched concave part 60*c* is situated (see, for example, FIG. 7). In other words, the second and the third communication holes 41, 41 are opened such that there are no obstructions other than the presence of the whole space of the inside of the tubular part 38 between the second and the third communication holes 41, 41 (see, for example, FIG. 12). Therefore, when making a comparison against the case where the notched concave part 60*c* is not provided and, instead thereof, the lower end part of the third plate member 6 is extended straight from sign 60*a* on the front end side to sign 60*b* on the rear end side (see sign 60' and alternate long and two short dashes line in FIGS. 7, 12, 13), the possible occurrence of troublesome conditions caused by obstruction between the second and the third communication holes 41, 41 can be prevented in the present invention. That is to say, the presence of the lower end part 60' brings the channel space of the tubular part 38 into a state of approximately being partitioned in the lateral direction (i.e., in the horizontal direction). Therefore, there is the possibility that, prior to being mixed sufficiently, the rich-side mixture flowing through the tubular part 38 is split into two lateral (horizontal) directions and reaches the second and the third communication holes 41, 41, as a result of which the rich-side mixture, divided and in an insufficient mixing state, flows into the second and the the third communication holes 41, 41. If the level of mixing remains insufficient, this will result in the occurrence of troublesome conditions such as causing the outer rich-side flame hole rows 35, 35 to be supplied with rich-side mixture at different concentration levels or such as causing the outer rich-side flame hole rows 35, 35 to be supplied with rich-side mixture in different amounts due to assembly positional errors of the lower end part 60'. The present embodiment is able to avoid the possibility of such troublesome conditions, and the flow of common rich-side mixture present in the common space of the tubular part 38 defined between the second and the third communication holes 41, 41 is split so that both the second and the third communication holes 41, 41 are each supplied with rich-side mixture in the same mixing state as the other.

Also, a description will be given not only in regard to measures for improving the mixing state of a lean-side mixture which is, after having being supplied via the tubular part 36, split and directed to the two inner spaces 37, 37 which are lean-side mixture supply channels, but also in regard to sealing measures for such a lean-side mixture. As explained above, the lean-side mixture flows from the first supply port 31 on one side of the tubular part 36 toward the other side. Thereafter, at the other side, the lean-side mixture changes its direction to flow upward and is split into two flow lines and directed to the two inner spaces 37, 37 by the lower end part 60*b* of the third plate member 6 (see, for example, FIG. 10). In this case, it is arranged that the lower end part 60*b* is inclined obliquely upward towards the rear (see FIG. 7), whereby the distance for which the lean-side mixture travels through the tubular part 36 can be made longer, when compared to the case where the flow of lean-side mixture is split in two flow lines which are directed respectively to the two inner spaces 37, 37, for example, by a lower end part 60" as indicated by virtual alternate long and two short dashes line which extends in parallel with the rich-side flame hole row 33. This enhances the mixing level of lean-side mixture in the inside of the tubular part 36, whereby it becomes possible to provide the supply of lean-side mixture of high mixing level to the lean-side flame hole rows 34, 34. On the other hand, the lower end part 60*b* of the central rich-side burner part 3*a*, exposed in a space at an upward curving part of the tubular part 36 so as to split the flow of lean-side mixture into two flow lines, respectively, to the two inner spaces 37, 37, is a part corresponding to the fold line T of the third plate member 6 formed by folding of the plate member 6*a* in the form of a single sheet (see FIG. 5), whereby it is ensured that the lean-side burner part 3*b* on the side of the tubular part 36 and the inner space 62 on the side of the central rich-side burner part 3*a* are cut off from each other, thereby maintaining high-level sealability between the lean-side burner part 3*b* and the inner space 62. This provides positive assurance that the occurrence of intermixing of rich-side mixture and lean-side mixture is prevented.

And, for the case of the rich-lean combustion burner 3, the two lean-side flame hole rows 34, 34 are sandwiched, from both sides, by either the rich-side flame hole rows 35, 33 or the rich-side flame hole rows 33, 35, whereby each lean-side flame produced in the lean-side flame hole rows 34, 34 is enclosed from both sides by rich-side flames. That is, the lateral arrangement sequence of rich-side flames and lean-side flames can be a sequence which is: RICH-LEAN-RICH-LEAN-RICH. Owing to this arrangement sequence, even in the case where there are provided two lean-side flame hole rows 34, 34 for increasing the area of lean-side flame hole row, it is possible to prevent lean-side flames from increasing in their flame length, whereby the height of the combustion chamber 22 (see FIG. 1) can be held short. And, by increasing the area (ratio) of lean-side flame hole while holding the height of the combustion chamber 22 short, it becomes possible to achieve not only further $NO_x$ reduction but also further stabilized combustion. In addition, it becomes possible to efficiently achieve better weight saving of the rich-lean combustion burner in realizing the same lean-side flame hole area, as compared to the case where a single rich-lean combustion burner is formed by sandwiching of a single lean-side flame hole row between two rich-side flame hole rows from both sides. Furthermore, it is possible that the flow of rich-side mixture introduced into the tubular part 38 from a single fuel gas and air supply port (i.e., the second supply port 32) for mixing of fuel gas and air is split into flow lines so that the rich-side mixture is directed (supplied), through the first communication holes 61, 61 of the central rich-side burner part 3*a* which are opened in fluid communication with the region on the closed end side of the tubular part 38, through the second communication hole 41 of the one outer rich-side burner part 35 and the third communication hole 41 of the other outer rich-side burner part 35, to their corresponding inner spaces 62, 51, 52. Owing to this, even in the case where three rich-side flame hole rows 35, 33, 35 are provided so as to lie, respectively, in the middle and on one and the other outsides of the middle one, it is positively ensured that the flow of rich-side mixture is smoothly split into three flow lines with a simple structure so that the rich-side flame hole rows 35, 33, 35 is provided with the supply of rich-side mixture. And, as described above, the central rich-side burner part 3*a* is made relatively thin in its lateral thickness, thereby making it possible to realize a compact rich-lean combustion burner with a flame arrangement sequence of RICH-LEAN-RICH-LEAN-RICH.

In addition, the following special effects can be achieved. That is, the one pair of the first communication holes 61, 61 through which the rich-side mixture flows into the inner space 62 in the inside of the third plate member 6 from the tubular part 38 are formed, respectively, in the plate parts 65, 65. In addition, because of the arrangement that the first communication holes 61, 61 are formed in a paired configuration, even if the opening area of the first communication hole 61 is set smaller than the opening area of the second or the third communication hole 41 (for example, the former is set half of the latter), it is ensured that the occurrence of conditions that will cause dust particles to adhere and accumulate in the vicinity of the first communication holes 61, 61 is prevented even when the rich-side mixture supplied from the second supply port 32 contains dust particles, for both the first communication holes 61, 61 are situated upstream of where the second and the third communication holes 41, 41 are formed. Therefore, the first communication holes 61, 61 are prevented from becoming clogged. And, it becomes possible to smoothly provide the supply of rich-side mixture mixed in the inside of the tubular part 38 to the rich-side flame hole row 33 of the central rich-side burner part 3*a* without any trouble.

In addition, even if the rich-side mixture contains dust particles, such dust particles are collected and accumulated in the pocket part 382, for the pocket part 382 is formed downstream of the second and the third communication holes 41, 41. Moreover, even if dust particles overflow from the pocket part 382 into the inner spaces 51, 52 via the second and the third communication holes 41, 41, such dust particles will subside and accumulate as the strength of the flow of rich-side mixture is reduced during passage through the second and the third protruding spaces 511, 521. This provides assurance that the rich-side flame holes 351 making up the rich-side flame hole row 35 are prevented from becoming clogged. Furthermore, even in the case where dust particles enter the inside of the inner space 62 through the first communication holes 61, 61, such dust particles are made to subside and accumulate because the flow of dust-containing rich-side mixture is reduced during passage through the first protruding space 621, as described above. This provides assurance that the rich-side flame holes 331 making up the central rich-side flame hole row 33 are prevented from becoming clogged. In addition, with the the first protruding space 621 interposed between the second and the third protruding spaces 511, 521, these protruding spaces 511, 521 are formed, respectively, on either lateral side of the first protruding space 621 (see FIG. 14), thereby forming narrowed parts 371, 371 in the inner spaces 37, 37 which are lean-side mixture supply channels. This further enhances the mixing level of rich-side mixture during its passage through the narrowed parts 371, 371.

Owing to the above, it is possible to avoid deterioration or destabilization in the state of combustion or ignition failure occurring when the supply of rich-side mixture is interrupted, whereby it becomes possible to accomplish improvements in the stability of combustion. This leads to the realization that, by making the central rich-side burner part 3*a* relatively thin in its lateral thickness, there can be formed a compact rich-lean combustion burner with a flame arrangement sequence that is: RICH-LEAN-RICH-LEAN-RICH. In addition, since the lower end part 60*b* of the central rich-side burner part 3*a* is formed by folding of the plate member 6*a* in the form of a single sheet, it is possible to effect tight shutoff between the lean-side burner part 3*b* on the side of the tubular part 36 and the central rich-side burner part 3*a* so as to maintain a state of high-level sealability, even if the lower end part 60*b* is placed in an exposed state that divides the lean-side mixture supply channel into the two inner spaces 37, 37 (see FIG. 14) at a position where the lean-side mixture supply channel formed by the tubular part 36 of the lean-side burner part 3*b* (see FIG. 14) curves upward after extension to the rear side (the right-hand side in FIG. 6) from the first supply port 31 on the front side (the upstream end side).

OTHER EMBODIMENTS

Figure 15:
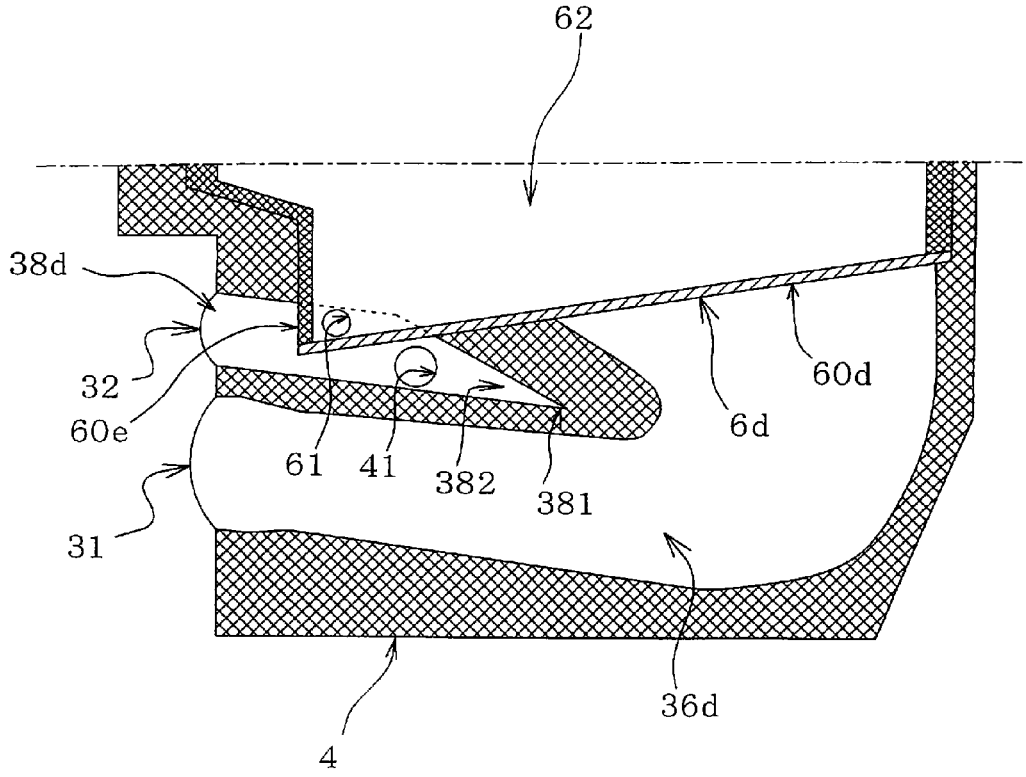
FIG. 15 is a corresponding diagram to FIG. 7 showing characteristic portions of another embodiment of the present invention.

In the aforesaid embodiment, it is arranged that the notched concave part 60*c* is provided on the side of the lower end part of the central rich-side burner part 3*a*, whereby the second and the third communication holes 41, 41 are opened in an opposite relation to each other wherein, in the lateral direction, there are no obstructions other than the space of the tubular part 38 between the second and the third communication holes 41, 41. This arrangement should, however, not be considered limitative. That is, it is not essential to provide the notched concave part 60*c*. For example, as it is seen from FIG. 15, even if the lower end part 60*d* of the third plate member 6*d* making up the central rich-side burner part is formed so as to extend in a straight line, it is possible that a front end part 60*e* of the lower end part 60*d* is projected into the inside of a tubular part 38*d* so that the first communication hole 61 is opened in the direction of the inside of the tubular part 38*d* while the second and the third communication holes 41, 41 (FIG. 15 shows only one of them) are placed in an opposite relation to each other via only the space in the inside of the tubular part 38*d*, with the lower end part 60*d* not obstructing the space between the second and the third communication holes 41, 41. That is, the tubular part 38*d* is inclined obliquely downward from its front end side (the left-hand side in FIG. 15) towards its rear end side (the right-hand side in FIG. 15) while on the other hand the lower end part 60*d* is inclined reversely relative to the tubular part 38*d*, that is, it is inclined obliquely upward from its front end side (the left-hand side in FIG. 15) towards its rear end side (the right-hand side in FIG. 15). In addition, although it is seen from FIG. 15 that the tubular part 36 which is a lean-side mixture introduction channel is also inclined as is the tubular part 38*d* which is a rich-side mixture introduction channel, the tubular part 36 may be inclined or extended horizontally.

In addition, in the foregoing embodiment, it is arranged that the second and the third communication holes 41, 41 are arranged in an opposite relation to each other in the lateral direction, which arrangement, however, should not be considered limiting. That is, there is no need to arrange the second and the third communication holes 41, 41 in an opposite relation to each other in the lateral direction. And, it is not required that the second and the third communication holes 41, 41 are exactly arranged face to face with each other. It suffices if the second and the third communication holes are located opposite to each other without any obstruction between the second and the third communication holes.

Furthermore, in the foregoing embodiment, it is arranged that the lower end part 60*b* of the third plate member 6 is formed at a slant, which arrangement, however, should not be considered limiting. For example, it may be arranged that the third plate member itself is obliquely arranged in the inside of the second plate member so that its lower end is positioned at an oblique slant relative to the lean-side mixture introduction channel formed by the tubular part 36 (see, for example, FIG. 7).

Additionally, in the foregoing embodiment, there is shown an example in which a single communication hole 61 is formed on each lateral side. This, however, should not be considered as a limitation. For example, it may be arranged that a plurality of first communication holes 61 (for example, two or three first communication holes 61) are provided on each lateral side.

What is claimed is:

1. A rich-lean combustion burner which comprises: (a) one row of central rich-side flame holes arranged such that it extends longitudinally in the middle of said rich-lean combustion burner; (b) two rows of lean-side flame holes arranged such that they sandwich therebetween said central rich-side flame hole row from both lateral sides thereof; and (c) two rows of outer rich-side flame holes arranged such that they sandwich therebetween both said two lean-side flame hole rows from the outsides thereof, wherein, for split-flow supplying of rich-side mixture from a common rich-side mixture introduction channel, the flow of rich-side mixture is split and supplied to said central rich-side flame hole row and said two outer rich-side flame hole rows, (i) wherein a lower end part of a formation member used to form by partition a rich-side mixture supply channel for supplying of rich-side mixture to said central rich-side flame holes is disposed so as to project, as a projecting part, into the inside of said rich-side mixture introduction channel, and wherein a first communication hole for split-flow supplying of rich-side mixture to said rich-side mixture supply channel from said rich-side mixture introduction channel is formed in said projecting part, with its opening oriented to face the interior of said rich-side mixture introduction channel;

(ii) wherein a second communication hole and a third communication hole for split-flow supplying of rich-side mixture to said two outer rich-side flame hole rows from said rich-side mixture introduction channel are formed in a formation member used to form by partition said rich-side mixture introduction channel, with their openings oriented to face the interior of said rich-side mixture introduction channel; and (iii) wherein said first communication hole is disposed, with its opening situated upstream, relative to the direction of the flow of rich-side mixture in the inside of said rich-side mixture introduction channel, of where said second and said third communication holes are opened.

2. The rich-lean combustion burner as set forth in claim 1, wherein said first communication hole has a smaller opening area than said second or said third communication hole.

3. The rich-lean combustion burner as set forth in claim 1, wherein said second and said third communication holes are disposed so as to leave an inner space on the side of a closed end of said rich-side mixture introduction channel which is downstream, relative to the direction of the flow of rich-side mixture in the inside of said rich-side mixture introduction channel, of the openings of said second and said third communication holes.

4. A rich-lean combustion burner which comprises: (a) one row of central rich-side flame holes arranged such that it extends longitudinally in the middle of said rich-lean combustion burner; (b) two rows of lean-side flame holes arranged such that they sandwich therebetween said central rich-side flame hole row from both lateral sides thereof; and (c) two rows of outer rich-side flame holes arranged such that they sandwich therebetween both said two lean-side flame hole rows from the outsides thereof, wherein, for split-flow supplying of rich-side mixture from a common rich-side mixture introduction channel, the flow of rich-side mixture is split and supplied to said central rich-side flame hole row and said two outer rich-side flame hole rows, (i) wherein a lower end part of a formation member used to form by partition a rich-side mixture supply channel for supplying of rich-side mixture to said central rich-side flame holes is disposed so as to project, as a projecting part, into the inside of said rich-side mixture introduction channel, and wherein a first communication hole for split-flow supplying of rich-side mixture to said rich-side mixture supply channel from said rich-side mixture introduction channel is formed in said projecting part, with its opening oriented to face the interior of said rich-side mixture introduction channel;

(ii) wherein a second communication hole and a third communication hole for split-flow supplying of rich-side mixture to said two outer rich-side flame hole rows from said rich-side mixture introduction channel are formed in a formation member used to form by partition said rich-side mixture introduction channel, with their openings oriented to face the interior of said rich-side mixture introduction channel; and (iii) wherein said second and said third communication holes are disposed so as to face each other without any obstruction, other than a space in the inside of said rich-side mixture introduction channel, therebetween.

5. The rich-lean combustion burner as set forth in claim 4, wherein said lower end part of said formation member used to form by partition said rich-side mixture supply channel is provided, at a position which is other than where said projecting part provided with said first communication hole is positioned and at which said second and said third communication holes are placed in an opposite relation to each other, with a notched concave portion.

6. The rich-lean combustion burner as set forth in claim 5, wherein said formation member forming by partition said rich-side mixture supply channel is provided by folding, along a fold line position, a single sheet of plate material in a developed state which comprises, on both sides of said plate material sheet across said fold line position, a pair of plate parts forming by partition said rich-side mixture supply channel so that said plate parts are in an opposite relation to each other, and in addition wherein a front end side portion of a lower end part of said formation member along said fold line position after said folding process serves as said projecting part projecting into the inside of said rich-side mixture introduction channel while, in order that said notched concave part is formed adjacent to said projecting part after said folding process, a notched opening is pre-formed across said fold line when said formation member is in said developed state.

7. The rich-lean combustion burner as set forth in claim 6, wherein it is configured that the flow of lean-side mixture introduced from a common lean-side mixture introduction channel is split and supplied to said two lean-side flame hole rows; and wherein a rear end side portion of said lower end part of said formation member formed by folding of said plate material sheet is disposed so as to pass transversely across a channel space of said lean-side mixture introduction channel at said split flow position, and in addition wherein said rear end side portion is disposed so as to incline obliquely upward towards the downstream side of the flow of lean-side mixture.

8. A combustion apparatus comprising a rich-lean combustion burner as set forth in any one of claims 1 through 7.

* * * * *